US009446610B2

(12) United States Patent
Koike et al.

(10) Patent No.: US 9,446,610 B2
(45) **Date of Patent: *Sep. 20, 2016**

(54) PRINTING DEVICE AND METHOD WITH CUTTER ACTUATED BY DISPLACEMENT OF MEDIA

(71) Applicant: Seiko Epson Corporation, Tokyo (JP)

(72) Inventors: Toshiaki Koike, Nagano-ken (JP); Takako Kasuga, Nagano-ken (JP); Yuya Iwasa, Nagano-ken (JP); Kiyomi Kuroda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/291,819

(22) Filed: May 30, 2014

(65) Prior Publication Data

US 2015/0000489 A1 Jan. 1, 2015

(30) Foreign Application Priority Data

Jun. 27, 2013 (JP) ..... 2013-135449

(51) Int. Cl.

| | |
|---|---|
| ***B41J 11/70*** | (2006.01) |
| ***B41J 29/38*** | (2006.01) |
| ***B41J 11/66*** | (2006.01) |
| ***B65H 23/185*** | (2006.01) |
| ***B65H 35/06*** | (2006.01) |
| ***B41J 11/00*** | (2006.01) |
| ***B41J 15/04*** | (2006.01) |
| ***B65H 20/02*** | (2006.01) |

(52) U.S. Cl.

CPC ..... *B41J 11/663* (2013.01); *B41J 11/0095* (2013.01); *B41J 11/70* (2013.01); *B41J 11/703* (2013.01); *B41J 15/042* (2013.01); *B41J 29/38* (2013.01); *B65H 20/02* (2013.01); *B65H 23/185* (2013.01); *B65H 35/06* (2013.01); *B65H 2301/11* (2013.01); *B65H 2511/11* (2013.01); *B65H 2701/1244* (2013.01); *B65H 2701/1936* (2013.01); *B65H 2801/03* (2013.01); *Y10T 83/145* (2015.04)

(58) Field of Classification Search

CPC ..... B41J 11/667; B41J 11/6673; G07B 5/02; A47K 10/3643; A47K 10/3625; A47K 10/3606

See application file for complete search history.

(56) References Cited

U.S. PATENT DOCUMENTS

| | | | |
|---|---|---|---|
| 4,319,132 | A | 3/1982 | Guiboard et al. |
| 4,340,150 | A | 7/1982 | Guiboard et al. |
| 5,222,818 | A | 6/1993 | Akiyama et al. |

(Continued)

FOREIGN PATENT DOCUMENTS

| | | | |
|---|---|---|---|
| CN | 202702888 | U | 1/2013 |
| EP | 2735448 | A1 | 5/2014 |

(Continued)

*Primary Examiner* — Daniel J Colilla

(57) ABSTRACT

A printer 1 has a processing unit that processes media; an automatic paper cutter 60 that cuts the media; a conveyance mechanism 63 that conveys media in the direction moving to an exit; a media orientation detection means 65 that detects displacement of the media after conveyance by the conveyance mechanism 63 stops; a limiting unit that restricts movement of the media toward the exit after conveyance by the conveyance mechanism 63 stops; and a media processing device control unit 100 that controls cutting the media by the automatic paper cutter 60 when the media orientation detection means 65 detects displacement of the media.

13 Claims, 12 Drawing Sheets

(56) References Cited

U.S. PATENT DOCUMENTS

| | | | | |
|---|---|---|---|---|
| 5,478,161 | A | 12/1995 | Suzuki et al. | |
| 5,588,762 | A | 12/1996 | Suzuki | |
| 5,921,686 | A | 7/1999 | Baird et al. | |
| 6,056,460 | A | 5/2000 | Suzuki | |
| 6,129,462 | A * | 10/2000 | Furuya et al. | 400/61 |
| 6,129,466 | A * | 10/2000 | Suzuki | 400/615.2 |
| 2004/0041018 | A1* | 3/2004 | Silverbrook et al. | 235/375 |
| 2006/0210344 | A1 | 9/2006 | Montagutelli | |
| 2007/0258748 | A1* | 11/2007 | Moriyama et al. | 400/621 |
| 2008/0229892 | A1 | 9/2008 | Campanini | |
| 2008/0310901 | A1 | 12/2008 | Michon | |
| 2009/0190170 | A1 | 7/2009 | Yoshie | |
| 2011/0085840 | A1 | 4/2011 | Shiohara | |
| 2012/0039651 | A1* | 2/2012 | Yamaguchi et al. | 400/613 |
| 2013/0233913 | A1 | 9/2013 | Inoue et al. | |
| 2014/0148335 | A1 | 5/2014 | Gyotoku et al. | |
| 2014/0197268 | A1* | 7/2014 | Zhang et al. | 242/563 |
| 2015/0259171 | A1* | 9/2015 | Campanini | B26F 3/002 225/1 |

FOREIGN PATENT DOCUMENTS

| | | | | |
|---|---|---|---|---|
| JP | 01118461 | A * | 5/1989 | B41J 11/66 |
| JP | 04-331169 | | 11/1992 | |
| JP | 2004-268207 | A | 9/2004 | |
| JP | 2004-345253 | A | 12/2004 | |
| JP | 2009-178886 | A | 8/2009 | |
| JP | 2011-051252 | | 3/2011 | |
| JP | 2013-039736 | A | 2/2013 | |
| WO | WO 9522445 | A1 * | 8/1995 | B26D 5/26 |
| WO | 2012066837 | A1 | 5/2012 | |

* cited by examiner

PRINTING DEVICE AND METHOD WITH CUTTER ACTUATED BY DISPLACEMENT OF MEDIA

BACKGROUND

1. Technical Field

The present disclosure relates to a media processing device that processes media, and to a control method of the media processing device.

2. Related Art

Media processing devices (such as tag and label producers) that produce tags, labels, and other tickets by printing images on a continuous medium and then cutting the medium are known from the literature. See, for example, JP-A-2011-51252.

However, when the media processing device cuts the media and produces tickets as described above, the tickets produced by cutting the media accumulate at the paper exit where the media is discharged, and can interfere with discharging media from the paper exit. When the media processing device is configured to cut the media when commanded by the user while media conveyance is stopped in order to prevent this problem, movement of the media must be prevented while media conveyance is stopped.

SUMMARY

The present disclosure is directed to preventing movement of the media while media conveyance is stopped, and preventing tickets from accumulating at the paper exit.

A media processing device according to one aspect of the disclosure has a processing unit configured to process media; a cutting unit configured to cut the media; an exit from which the media is discharged; a conveyance unit configured to convey the media in the direction moving to the exit; a detection unit configured to detect displacement of the media after conveyance by the conveyance unit stops; a limiting unit configured to limit movement of the media in the direction moving toward the exit after conveyance by the conveyance unit stops; and a control unit configured to control cutting the media by the cutting unit when the detection unit detects displacement of the media.

When media displacement is detected in this aspect of the disclosure, the media is cut and a ticket is issued. As a result, tickets can be prevented from accumulating at the paper exit. Movement of the media can also be prevented by the limiting unit while media conveyance is stopped.

In another aspect of the disclosure, the detection unit detects displacement in a different direction than the direction in which the media moves to the exit.

In another aspect of the disclosure, the conveyance unit has a conveyance roller that rotates and moves the media toward the exit; and the limiting unit is a limit member that restricts rotation of the conveyance roller in the direction in which the media moves to the paper exit.

This aspect of the disclosure can use a paper feed roller to suppress movement of the media.

In another aspect of the disclosure, the conveyance unit has a stepper motor that produces drive power; and the limiting unit is a drive control unit that holds the stepper motor.

This aspect of the disclosure can use a stepper motor to suppress movement of the media.

In another aspect of the disclosure, the media has an IC tag to which data is written; and the processing unit is a reader/writer unit that reads/writes data in the IC tag.

In another aspect of the disclosure, the processing unit is a print unit that prints on the media.

Another aspect of the disclosure is a control method of a media processing device, including steps of: processing media; moving the processed media in the direction toward an exit and discharging the media from the exit; stopping movement of the media after discharging the media from the exit; restricting movement of the media in the direction moving to the exit after stopping movement of the media; and cutting the media when change in the position of the media is detected.

When media displacement is detected by the control method according to this aspect of the disclosure, the media is cut and a ticket is issued. As a result, tickets can be prevented from accumulating at the paper exit. Movement of the media can also be prevented by the limiting unit while media conveyance is stopped.

Movement (displacement) of the media in the disclosure is movement in a different direction than the direction in which the media travels to the exit.

Other objects and attainments together with a fuller understanding of the disclosure will become apparent and appreciated by referring to the following description and claims taken in conjunction with the accompanying drawings.

DESCRIPTION OF EMBODIMENTS

A preferred embodiment of the present disclosure is described below with reference to the accompanying figures.

Figure 1:
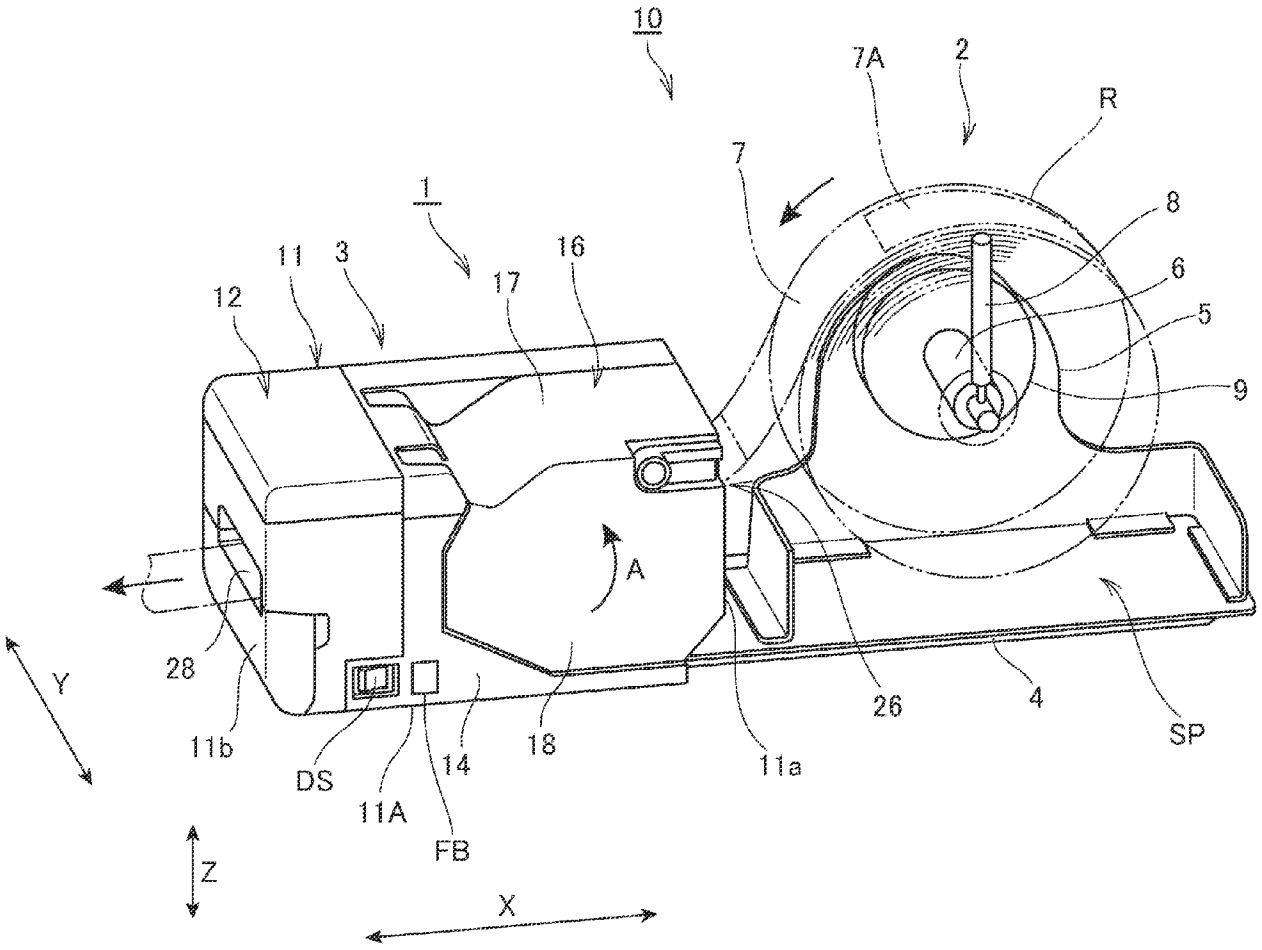
FIG. 1 an oblique view illustrating a ticket issuing device according to a preferred embodiment of the disclosure.

FIG. 1 illustrates a ticket issuing device 10 according to this embodiment of the disclosure.

In FIG. 1, the x-axis indicates the conveyance direction of the medium used in the ticket issuing device 10, the y-axis indicates the direction of the width of the medium, and the z-axis indicates the direction perpendicular to the x-axis and the y-axis.

The ticket issuing device 10 according to this embodiment of the disclosure is installed at the service counter of an airline in an airport, for example, and is used to issue tickets such as baggage tags and boarding passes.

A baggage tag or boarding pass issued by the ticket issuing device 10 has an embedded IC (integrated circuit) tag, and necessary information is recorded in the IC tag. For example, information such as the number of the flight that is to carry the luggage (baggage) and the date and time the baggage tag was issued are recorded. Information is also printed on the surface of the baggage tag or boarding pass. For example, the flight number of the plane, the name of the owner of the luggage, and other predetermined information is printed.

As shown in FIG. 1, the ticket issuing device 10 includes a printer 1 (media processing device), and a paper feed device 2 that supplies media to the printer 1.

The paper feed device 2 includes a base 4 that is removably connected to the printer unit 3, a paper support unit 5 attached to the base 4, and a roll paper spindle 6 attached to the paper support unit 5. The roll paper R fits onto the roll paper spindle 6 from the distal end thereof. A stop 8 that prevents the roll paper from slipping off the roll paper spindle 6 is attached perpendicularly to the roll paper spindle 6 at the distal end of the roll paper spindle 6. A disk-shaped spacer 9 for adjusting to the width of the roll paper is removably attached to the base end of the roll paper spindle 6, thereby enabling installing and using roll paper of different widths.

Roll paper R and fanfold paper can be selectively stored in the paper feed device 2 and supplied to the printer 1. Media stored in the ticket issuing device 10 are collectively referred to as medium B below.

The roll paper R in this embodiment is a medium comprising paper labels 7 of a constant length connected continuously lengthwise. After a specific process described below is applied by the printer 1, each paper label 7 is cut off and used as a ticket (such as a baggage tag). An RFID (radio frequency identification) tag 7A (IC tag) is affixed or embedded at a specific position on each paper label 7.

The roll paper R is set in the paper feed device 2 in FIG. 1.

The base 4 can also be used as a tray for fanfold paper, which is another type of continuous paper. Fanfold paper is a medium composed of ticket portions of a constant length folded together at a regular interval into a stack. After a specific process described below is applied by the printer 1, each ticket portion is cut off and used as a ticket (such as a boarding pass). When using fanfold paper, the fanfold paper is stored in the space SP created by the base 4 and paper support unit 5.

The main unit 3 of the printer 1 has an outside case 11. This outside case 11 includes a main case 11A, front case 12, and cover 16.

The main case 11A is the base part of the outside case 11, and other case members of the outside case 11 and the paper feed device 2 described above are attached to the main case 11A. A power switch DS that turns the power on/off, and a feed button FB that instructs feeding the medium B, are disposed to the main case 11A.

The front case 12 is attached to the main case 11A at the opposite end of the printer 1 as the paper feed device 2. A rectangular discharge exit 28 (paper exit) that is long in the Y direction is formed in the front 11*b* of the front case 12 in the middle between the top and bottom. The print mechanism 61 described below is housed inside the front case 12.

The cover 16 can open and close freely to the outside case 11. A paper entrance 26 is formed between the back end 11*a* of the outside case 11 and the end of the cover 16.

Figure 2:
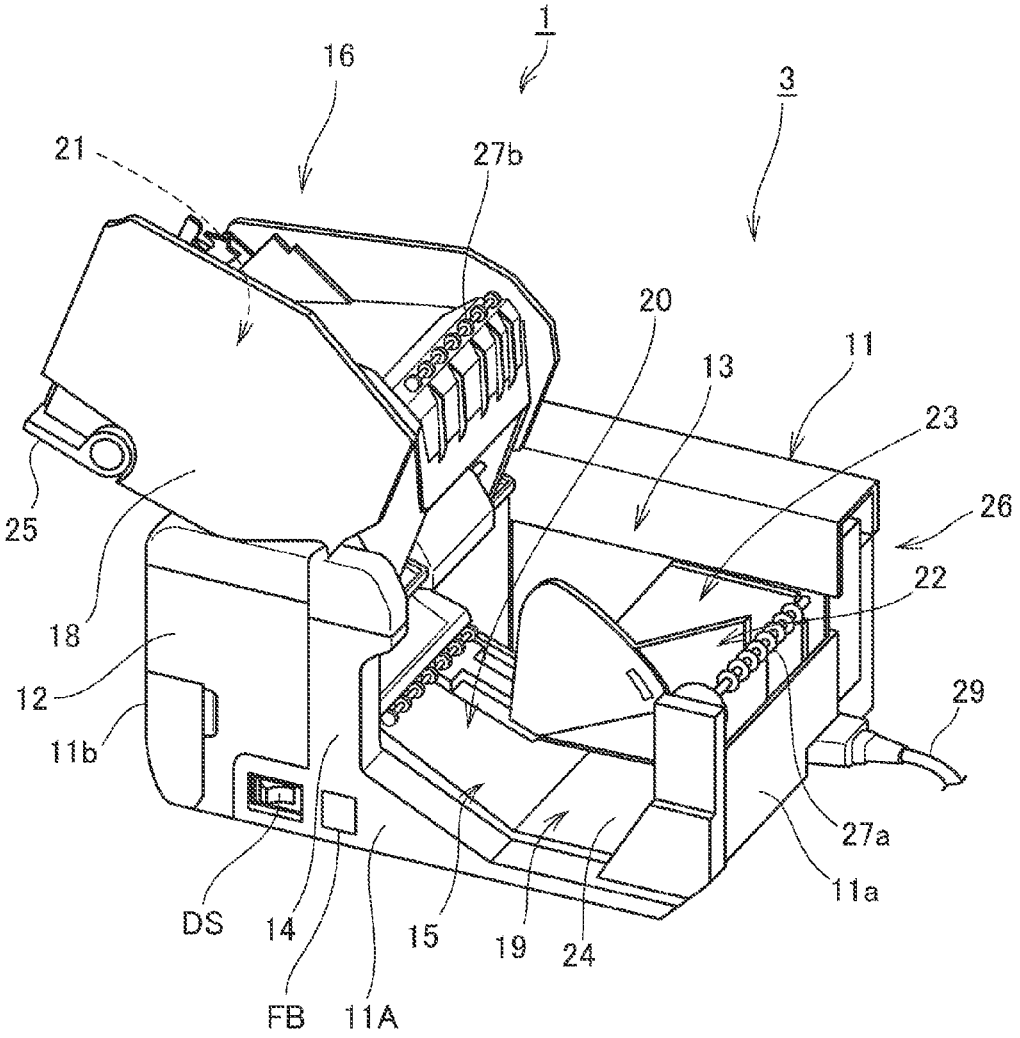
FIG. 2 is an oblique view of the printer when the cover is open.

FIG. 2 is an oblique view of the printer unit 3 with the cover 16 open.

The cover 16 covers the medium B paper conveyance path 19, and can open and close in the direction of arrow A (FIG. 1) pivoting at the end towards the front of the printer.

As shown in FIG. 2, rotating the cover 16 open exposes a top opening 13. A side opening 15 contiguous to the top opening 13 is formed on one side 14 of the outside case 11.

When closed as shown in FIG. 1, the cover 16 covers the top opening 13 and side opening 15. The cover 16 includes a top cover part 17 that covers the top opening 13, and a side cover part 18 that covers the side opening 15. The cover 16 pivots at the end of the top cover part 17 at the front of the printer unit 3 and can open from the closed position shown in FIG. 1 to the fully open position shown in FIG. 2. When the cover 16 opens, a paper conveyance path 19 for the medium B formed inside the outside case 11, and a paper stage 20 formed in the paper conveyance path 19, are open and can be accessed from the top opening 13 and side opening 15.

One side of the width of the paper conveyance path 19, that is, one side of the printer unit 3, is a first paper guide 21 formed on the inside side of the side cover part 18. The other side of the width is either a second paper guide 22 that is removably installed to the bottom 24, which is the bottom of the paper conveyance path 19, or a third paper guide 23. When the second paper guide 22 is installed, the paper labels 7 can be guided by the first paper guide 21 and second paper guide 22, and when the second paper guide 22 is removed, the paper labels 7 can be guided by the first paper guide 21 and the third paper guide 23.

A lower guide roller 27*a* is disposed inside the paper entrance 26 on the outside case 11 side, and an upper guide roller 27*b* that is opposite the lower guide roller 27*a* when the cover 16 is in the closed position is disposed on the cover 16 side.

Figures 3A, 3B:
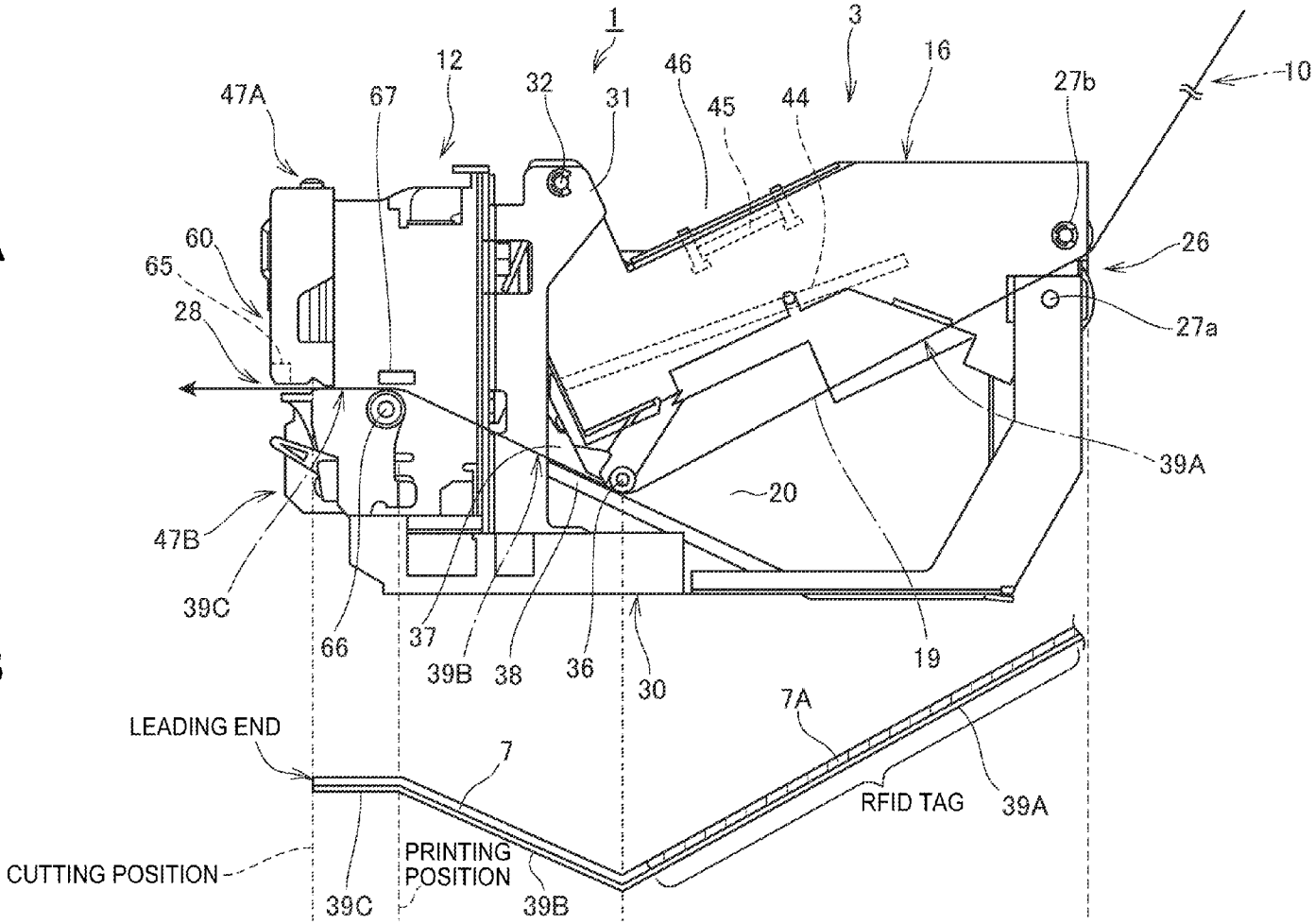
FIGS. 3A and 3B illustrate internal mechanisms of the printer.

FIG. 3 (A) illustrates the internal configuration of the printer unit 3, and shows the printer 1 from the side. FIG. 3 (B) shows the paper conveyance path 19 from FIG. 3 (A).

The internal mechanism of the printer unit 3 is configured with parts of the printer unit 3 mounted on a sheet metal main frame 30 that is covered by the outside case 11. Left and right support arms 31 that extend vertically are disposed to the main frame 30, a hinge pin 32 spans widthwise to the outside case 11 between the support arms 31, and the cover 16 can pivot freely on the axis of the hinge pin 32.

A tension roller 36 extends widthwise at a position below the paper entrance 26 and at the front of the paper stage 20 inside the printer unit 3. A paper conveyance path 19 that conveys media (paper labels 7 in the example shown in FIG. 3 (A)) past the tension roller 36 and a platen roller 66 (conveyance roller) located downstream from the tension roller 36 is formed between the paper entrance 26 and paper exit 28.

The paper conveyance path 19 includes an upstream path slope 39A near the paper entrance 26, a downstream path slope 39B, and a horizontal path 39C further downstream near the paper exit 28. The upstream path slope 39A extends at a downward angle from the paper entrance 26 to the tension roller 36. The downstream path slope 39B continues downstream from the tension roller 36 on an upward slope to the platen roller 66. The downstream path slope 39B is formed by paper guides 37, 38 disposed vertically opposite each other. The horizontal path 39C continues downstream horizontally to the front from the platen roller 66 to the paper exit 28.

A thermal head 67 that prints on medium B (paper labels 7 in the example in FIG. 3) is disposed facing down on the downstream path slope 39B, and the platen roller 66 is located below and opposite the thermal head 67. The platen roller 66 is disposed to push against the heat-emitting face of the thermal head 67, and the paper labels 7 are conveyed by rotation of the platen roller 66. An automatic paper cutter 60 is disposed to the horizontal path 39C on the downstream side of the platen roller 66, and the print medium (such as the paper labels 7) printed by the thermal head 67 is cut by the automatic paper cutter 60.

To print a paper label 7, the user first opens the cover 16, and pulls out the end of the paper labels 7 set in the paper feed device 2 and inserts it to the paper entrance 26. The paper labels 7 are guided by the first paper guide 21 and the second paper guide 22 or third paper guide 23 through the upstream path slope 39A to the tension roller 36. The paper labels 7 are then conveyed from the tension roller 36 along the downstream path slope 39B and between the thermal head 67 and platen roller 66, through the horizontal path 39C, and out from the paper exit 28. When the cover 16 is then closed, the leading end of the paper label 7 is held between the platen roller 66 and thermal head 67, and can be conveyed.

A tag reader/writer 46 (data reader/writer) that writes data to and reads data from an RFID tag 7A is disposed inside the outside case 11.

The tag reader/writer 46 communicates wirelessly with the RFID tag 7A by means of an antenna 44 and RF communication circuit 45. As shown in FIG. 3 (A), the antenna 44 is disposed facing the upstream path slope 39A (conveyance path), and the upstream path slope 39A is the data read/write position where the tag reader/writer 46 writes data and reads data. More specifically, the tag reader/writer 46 writes data and reads data while the RFID tag 7A affixed to the label 7 is located in the range of the upstream path slope 39A.

An RFID tag 7A is a passive IC tag that has an antenna for receiving RF signals transmitted from an external device such as the tag reader/writer 46, and drives an IC chip by means of power induced in the antenna. The tag reader/writer 46 and RFID tag 7A in this embodiment of the disclosure send and receive radio signals using a common protocol for RF tags.

More specifically, to write data to or read data from the RFID tag 7A, the tag reader/writer 46 first sends a carrier wave of a specific frequency, and sends a detection signal superimposed on the carrier wave. When EMF is induced in the antenna of the RFID tag 7A by the carrier wave transmitted by the tag reader/writer 46, the IC chip of the RFID tag 7A turns on due to the induced power, receives the detection signal, and then sends a signal responding to the detection signal. When the response signal sent by the RFID tag 7A is received, the tag reader/writer 46 sets the RFID tag 7A as the target for writing data and reading data, and sends a signal to start writing and reading data, while continuing to output the carrier wave. Next, the tag reader/writer 46 and RFID tag 7A communicate wirelessly while the tag reader/writer 46 continues outputting the carrier wave, reads data recorded in the RFID tag 7A, and writes data to the rewritable storage area in the IC chip of the RFID tag 7A.

Figure 4:
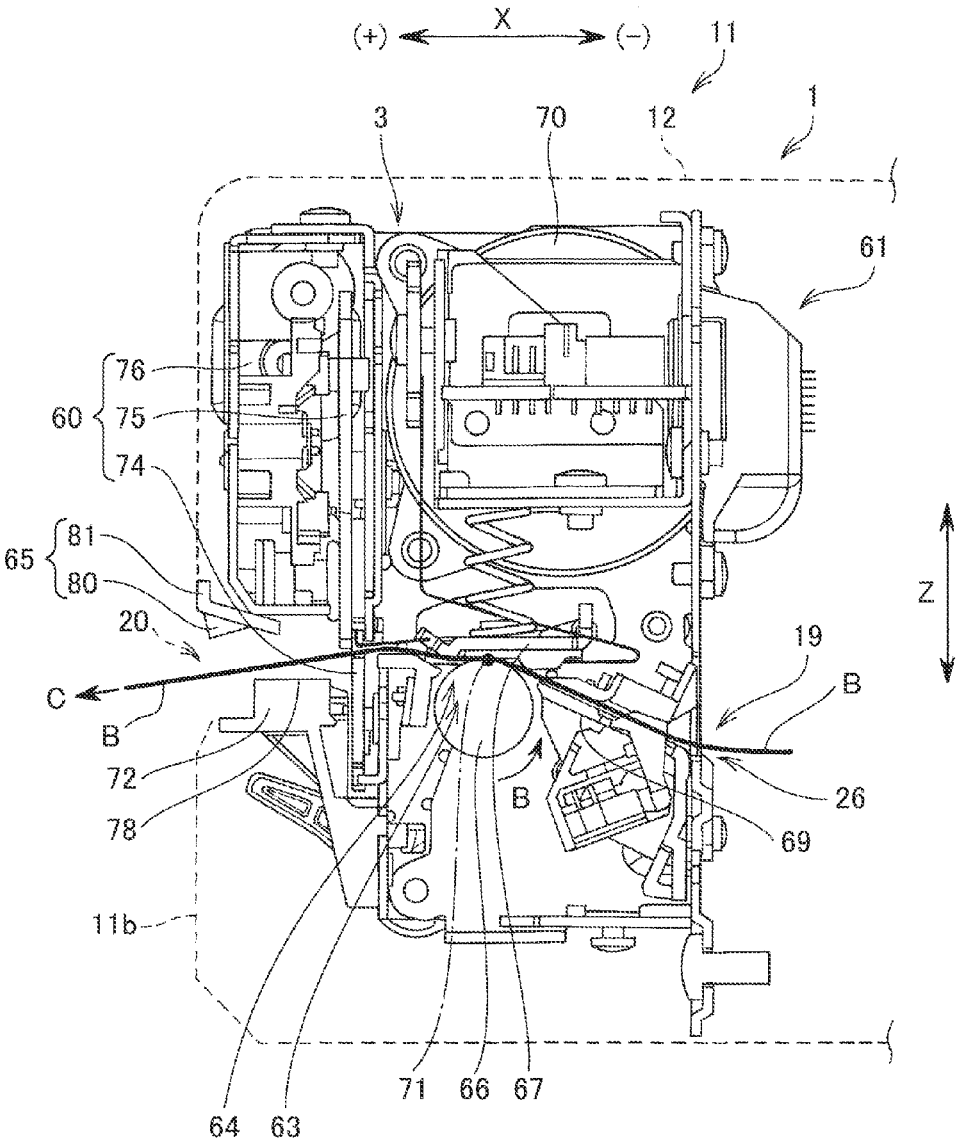
FIG. 4 is a section view illustrating the main components of the printer 1.
Figure 5:
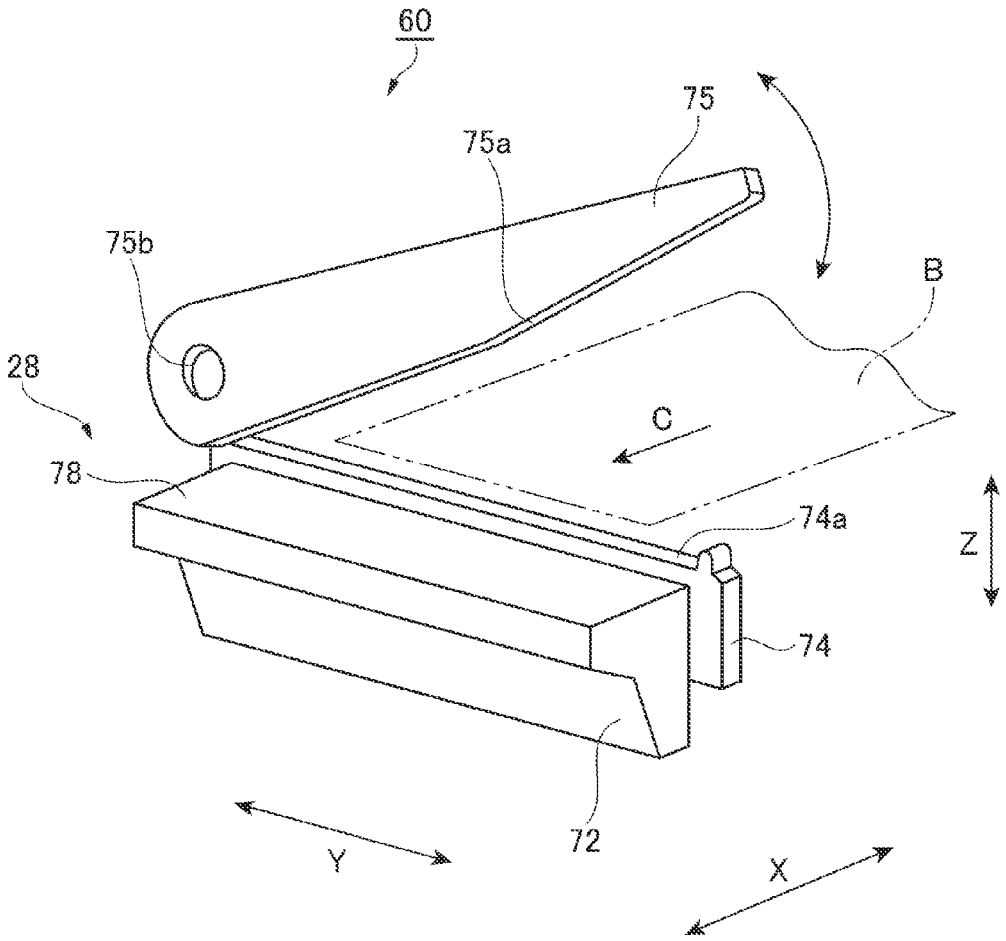
FIG. 5 describes the area around the automatic cutter.

FIG. 4 is a section view illustrating essential components of the printer 1. FIG. 5 illustrates the area around the automatic paper cutter 60 (described below) used as a cutting mechanism. Axes X, Y, Z in FIG. 4 and FIG. 5 are the same as axes X, Y, Z in FIG. 1.

As shown in FIG. 4, the print mechanism 61 is housed in the front case 12 of the outside case 11, and includes a conveyance mechanism 63 (conveyance unit), a print mechanism 64 (print unit), the automatic paper cutter 60 (cutting unit), and a media orientation detection means 65 (detection unit).

The conveyance mechanism 63 conveys the medium B through the paper conveyance path 19 inside the printer 1.

The conveyance mechanism 63 includes the platen roller 66 (conveyance roller) disposed at a specific position on the paper conveyance path 19, and the thermal head 67 disposed opposing the platen roller 66. The paper entrance 26 to the print mechanism 61 is disposed on the upstream side (−) side of the conveyance mechanism 63 on the x-axis. The medium B is conveyed through the paper entrance 26 inside the printer 1, and is nipped between the thermal head 67 and platen roller 66. A paper guide 69 that guides the medium B is disposed on the paper conveyance path 19 between the paper entrance 26 and the thermal head 67 and platen roller 66.

Torque from the paper feed motor 70 is transferred through a gear train or other transfer mechanism not shown to the platen roller 66. When the platen roller 66 turns forward (the direction of arrow B in FIG. 4, the medium B is conveyed in conjunction with this rotation forward (from the upstream (−) side on the x-axis to the downstream (+) side) through the paper conveyance path 19. When the platen roller 66 turns in the opposite direction (the opposite direction as arrow B), the medium B is conveyed in reverse.

The paper feed motor 70 is a stepper motor.

The print mechanism 64 includes the thermal head 67.

The thermal head 67 has a heat unit 71 on the head surface facing the platen roller 66, and prints by applying heat to the medium B. The heat unit 71 has a plurality of heat elements arrayed in a line in the Y direction. When printing, the heat unit 71 part of the thermal head 67 is set directly opposite the platen roller 66, the medium B is conveyed by platen roller 66, and the desired heat elements in the plural heat elements of the heat unit 71 are selectively heated. The printing surface of the medium B is coated with a heat-sensitive color layer, and the part opposite the heated heat element therefore changes color, forming a dot.

The medium B on which an image was printed then passes the automatic paper cutter 60 and media orientation detection means 65 described below, and is discharged to the outside from the paper exit 28 disposed on the downstream (+) side of the print mechanism 61 on the x-axis. When discharged, the medium B stops temporarily on the paper stage 72 disposed below the paper exit 28 on the z-axis.

The automatic paper cutter 60 used as the cutting mechanism functions to cut the medium B on which an image was printed by the thermal head 67 at the desired length, producing a ticket. The automatic paper cutter 60 in this embodiment is a scissor cutter that operates by one knife pivoting at one end thereof to and away from the other knife. Various other types of devices can alternatively be used as the automatic paper cutter 60, including a guillotine cutter in which one knife moves in a straight line to and away from the other knife.

As shown in FIG. 4 and FIG. 5, the automatic paper cutter 60 has a fixed knife 74, a movable knife 75, a cutter drive motor 76, and a movable knife drive transfer mechanism not shown. The fixed knife 74 is a rectangular blade with a straight cutting edge 74*a* formed along one side. The fixed knife 74 is fastened below the paper conveyance path 19 on the z-axis with the cutting edge 74*a* extending on the y-axis. The movable knife 75 is a blade with a straight cutting edge 75*a* formed on one side, and a pivot hole 75*b* formed near one end. The pivot hole 75*b* is disposed outside the path of the medium B on the y-axis.

The automatic paper cutter 60 also includes the cutter drive motor 76, and drive power from the cutter drive motor 76 is transferred through a movable knife drive transfer mechanism not shown to the movable knife 75. As a result, the movable knife 75 can pivot on the pivot hole 75*b*, and can pivot toward and away from the fixed knife 74 by driving the cutter drive motor 76. As a result, the medium B set between the fixed knife 74 and movable knife 75 is cut.

As shown in FIG. 4 and FIG. 5, the paper stage 72 is plastic in this example, and is disposed across the gap between the conveyance mechanism 63 and the front case 12 of the outside case 11, forming part of the surface of the paper conveyance path 19 over which the medium B slides. The paper stage 72 includes a rectangular paper guide surface 78 with the long side aligned with the paper width (y-axis) across the paper conveyance path 19, and the short side aligned with the paper conveyance direction (x-axis). The surface of the paper guide surface 78 is disposed slightly lower than the position of the cutting edge 74*a* of the fixed knife 74 on the z-axis. The paper guide surface 78 functions to guide the bottom surface of the medium B conveyed through the paper conveyance path 19.

The media orientation detection means 65 is described next with reference to FIG. 4 and FIG. 6.

When the medium B is displaced in a direction different from the media conveyance direction (upward in this example) after being discharged from the paper exit 28, the media orientation detection means 65 (detection unit) detects media displacement.

Figure 6A:
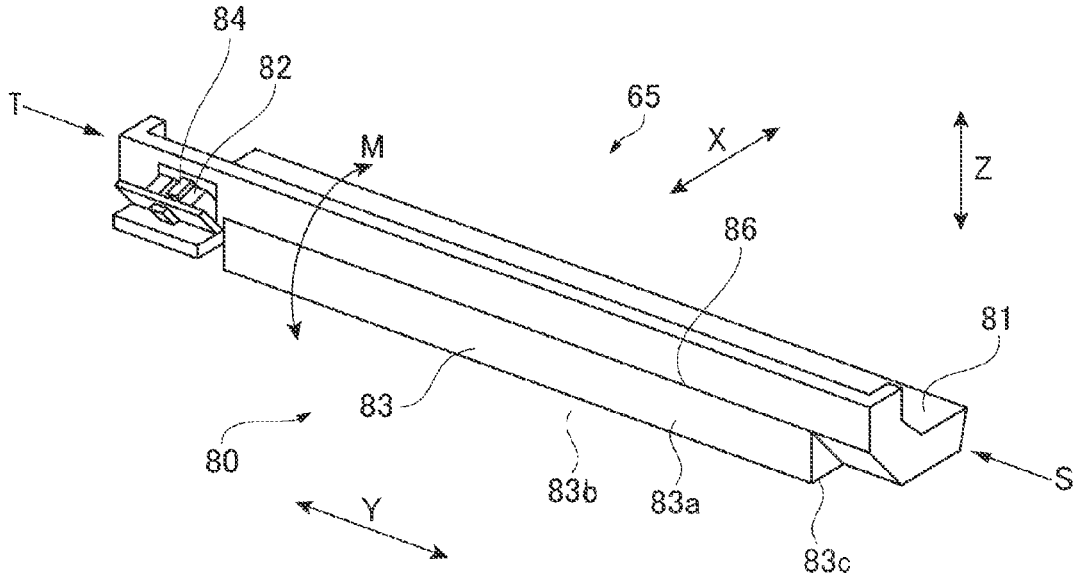
FIGS. 6A, 6B and 6C illustrate the media orientation detection means.
Figure 6B:
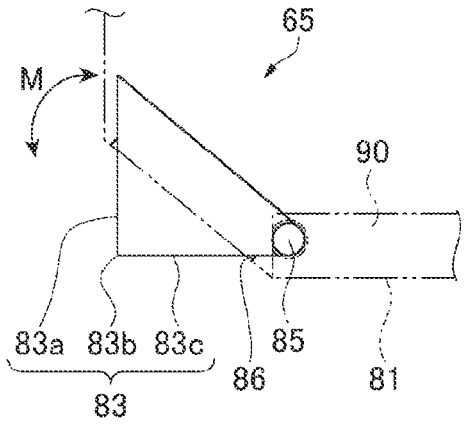
Figure 6C:
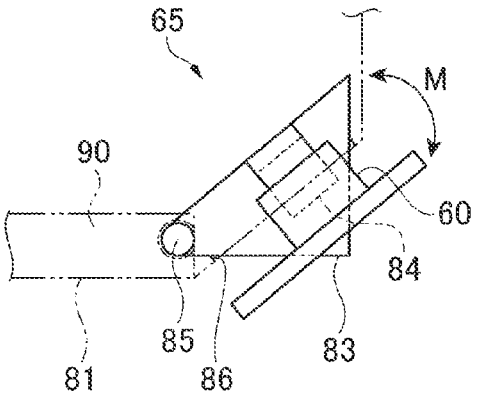

FIG. 6 describes the media orientation detection means 65, (A) being an oblique view of the media orientation detection means 65 from the direction in which the medium B is discharged, (B) being a view from the direction of arrow S in (A), and (C) being a view from the direction of arrow T in (A). Axes X, Y, Z in FIG. 6 are the same as axes X, Y, Z in FIG. 1.

As shown in FIG. 4, the media orientation detection means 65 is disposed to a position opposite the paper guide surface 78 of the paper stage 72 at the paper exit 28 of the outside case 11, that is, to a position facing the printing surface of the printed medium B resting on the paper guide surface 78.

As shown in FIG. 6, the media orientation detection means 65 includes a detection lever 80, a detection lever support 81, and a detector 82.

The detection lever 80 is plastic in this example, and includes a sensing part 83, a interrupter 84, and support pins 85. The sensing part 83 is the main body of the detection lever 80, and is triangular in section with two rectangular surfaces 83*a*, 83*c*, the long sides of which are aligned with the y-axis in FIG. 4 and have a length greater than the maximum width of the medium B, that meet at a single peak 83*b*. Two support pins 85 are formed extending from the one surface 83*a* on an extension of the opposite long side as peak 83*b*. A rectangular interrupter 84 is formed protruding from one end on the y-axis.

As shown in FIG. 4, the detection lever support 81 is the top part on the z-axis in FIG. 1 of the paper exit 28 formed in the front case 12. A rectangular window 86 with the long side on the y-axis is formed in the detection lever support 81, and the triangular section part of the sensing part 83 of the detection lever 80 can fit into this window 86 with the peak 83*b* on the outside. Support receivers 90 are disposed to positions that receive the two support pins 85 of the detection lever 80 when the sensing part 83 is fit into the window 86. As a result, the detection lever 80 can pivot on these two support pins 85 in the direction in which the peak 83*b* of the sensing part 83 moves in and out through the window 86 in the detection lever support 81 (the direction of arrow M in FIG. 6).

A detector 82 with a sensing part in the range of movement of the interrupter 84 disposed at one end when the detection lever 80 pivots on the support pins 85 is also disposed to the detection lever support 81. The detector 82 is preferably a transmissive photosensor, for example. The detector 82 includes an emitter and a receptor, and the receptor receives light emitted from the emitter. The detector 82 outputs a signal based on whether light was detected by the receptor, or the amount of light received by the receptor. As a result, sensor output changes and operation of the detection lever 80 can be detected based on whether or not the interrupter 84 interrupts the light beam of the detector 82.

Also referring to FIG. 4 and FIG. 6, the method of detecting the orientation of the medium B is described next. The medium B on which an image was printed by the print mechanism 61 described above is conveyed by the print mechanism 61 until the trailing end of the slip issued as a ticket reaches the cutting position of the automatic paper cutter 60, and then rests on the paper stage 72.

The operator then lifts the printed medium B when the operator wants to issue the ticket, for example. The medium B raised from the resting position thus contacts the sensing part 83 (the peak 83*b* part) of the detection lever 80 of the media orientation detection means 65. When the medium B is raised further, the sensing part 83 of the detection lever 80 in contact with the medium B pivots on the two support pins 85 and rotates in the direction of arrow M. The interrupter 84 formed in unison with the detection lever 80 therefore also pivots. As a result, the interrupter 84 moves out of the optical axis of the detector 82 of the media orientation detection means 65, and the output of the detector 82 changes.

By detecting this change in output, change in the orientation (displacement in a specific direction) of the medium B paused on the paper stage 72 can be detected. Note that the length on the y-axis of the sensing part 83 is greater than the width of the medium B. As a result, the detection lever 80 can still pivot, and change in the orientation of the medium B can be detected, even if the operator twists or lifts the medium B at an angle to the paper width.

Figure 7:
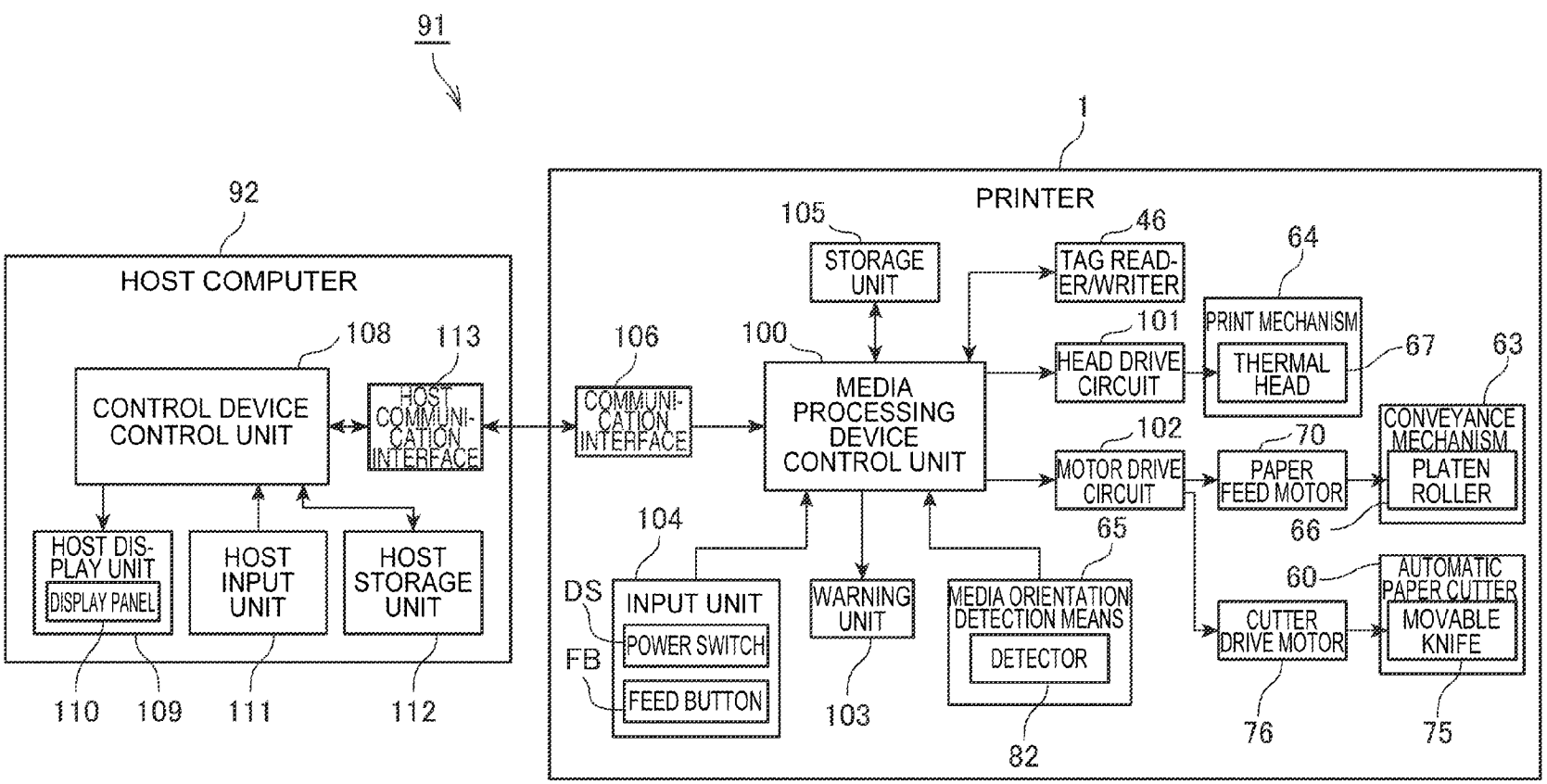
FIG. 7 is a block diagram illustrating the functional configuration of the host computer and printer.

FIG. 7 is a block diagram illustrating the functional configuration of a media processing system 91 (print processing system) according to this embodiment of the disclosure.

The media processing system 91 includes a printer 1 (media processing device) and a host computer 92 (control device). Configured as described above, the printer 1 is a device that cuts a medium B and issues a ticket after discharging a specific amount of the medium B from the paper exit 28. The host computer 92 is a computer that controls the printer 1, and can send control data (described below) instructing printing an image to the printer 1.

As shown in FIG. 7, the printer 1 has a media processing device control unit 100 (control unit).

The media processing device control unit 100 includes CPU, ROM, RAM, and other peripheral circuits, and controls the printer 1.

The media processing device control unit 100 controls the tag reader/writer 46 to read data from and write data to an RFID tag 7A. For example, when the paper label 7 is used as a baggage tag, the media processing device control unit 100 may write data identifying the airline, airport of departure, destination airport, transiting airports, the service counter where the baggage tag was issued, the number of the boarding pass, and the flight number to the RFID tag 7A.

In this embodiment of the disclosure, the tag reader/writer 46 functions as a processing unit that processes the medium B as controlled by the media processing device control unit 100 based on control data received from the host computer 92.

The media processing device control unit 100 controls the head drive circuit 101, drives the thermal head 67, and prints images on the medium B.

In this embodiment of the disclosure, the print mechanism 64 functions as a print unit as controlled by the media processing device control unit 100. The print mechanism 64 also functions as a processing unit that processes the medium B as controlled by the media processing device control unit 100 based on control data received from the host computer 92.

The media processing device control unit 100 also controls a motor drive circuit 102 and drives the paper feed motor 70. When the paper feed motor 70 is driven, the platen roller 66 turns and conveys the medium B according to rotation of the platen roller 66.

In this embodiment of the disclosure the conveyance mechanism 63 functions as a conveyance unit as controlled by the media processing device control unit 100.

The media processing device control unit 100 also controls the motor drive circuit 102 and drives the cutter drive motor 76. The movable knife 75 moves and cuts the medium B when the cutter drive motor 76 is driven.

In this embodiment, the automatic paper cutter 60 functions as a cutting unit as controlled by the media processing device control unit 100.

As described above, the detector 82 outputs the detection value of the sensor to the media processing device control unit 100. Based on change in the output of the detector 82, the media processing device control unit 100 detects that the medium B was displaced upward.

The warning unit 103 includes a buzzer, and outputs an electronic sound in a specific mode as controlled by the media processing device control unit 100.

The input unit 104 includes a power switch DS and feed button FB, detects operation thereof, and outputs to the media processing device control unit 100.

The storage unit 105 includes EEPROM or other nonvolatile memory, and nonvolatilely stores data rewritably.

The communication interface 106 communicates with the host computer 92 according to specific communication protocol as controlled by the media processing device control unit 100. The communication interface 106 and media processing device control unit 100 and media processing device control unit 100 together function as a communication unit.

As shown in FIG. 7, the host computer 92 includes a control device control unit 108.

The control device control unit 108 has a CPU, ROM, RAM, and other peripheral circuits, and controls the host computer 92.

The host display unit 109 has an LCD panel or other display panel 110, and displays images on the display panel 110 as controlled by the control device control unit 108.

The host input unit 111 is connected to operating switches or input devices, detects operation of the operating switches or input devices, and outputs to the control device control unit 108.

The host storage unit 112 includes EEPROM, a hard disk drive, or other nonvolatile memory, and stores data rewritably.

The host communication interface 113 communicates with the printer 1 according to a specific communication protocol as controlled by the control device control unit 108.

The control device control unit 108 and host communication interface 113 together function as a communication unit that sends control data instructing the process to apply to the medium B.

Figure 8:
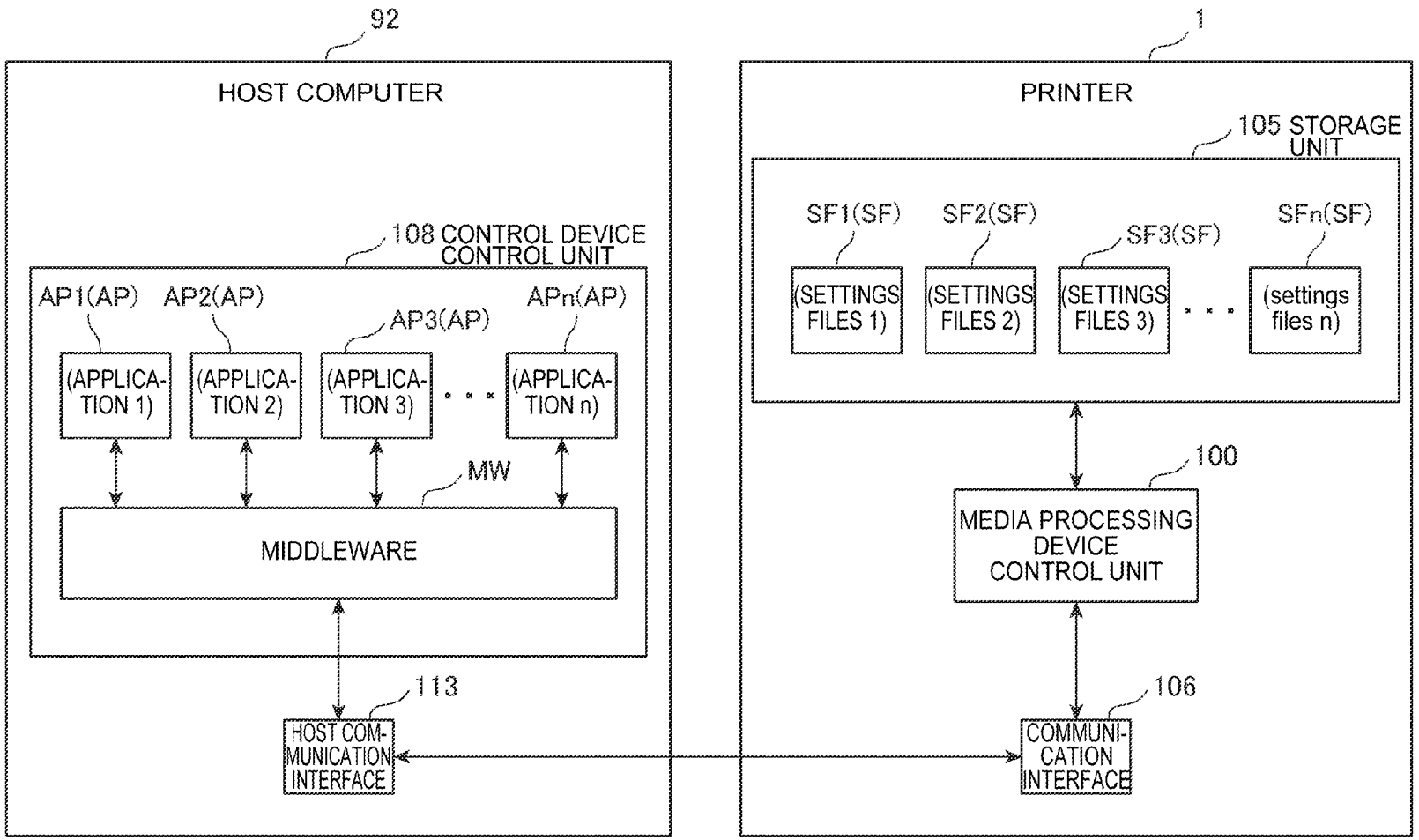
FIG. 8 is a function block diagram of the main parts of the host computer and printer.

FIG. 8 is a function block diagram showing main parts of the printer 1 and host computer 92.

For convenience of description, programs and function blocks are expressed by equivalent blocks in FIG. 8.

Multiple applications AP (first application AP1 to n-th application APn) are installed in the host computer 92, and any of the applications can be selectively started and run.

In this example as described above, the printer 1 is installed at the service counter of an airline in an airport, and multiple airlines may share one printer 1 and a media processing system 91 including the printer 1.

In the following example, multiple airlines share the media processing system 91.

When multiple airlines share a single media processing system 91 as in this example, each airline uses the printer 1 to produce baggage tags and boarding passes through functions of a dedicated application. An application AP for each airline is therefore pre-installed to the host computer 92.

In this example, n applications AP referred to as application 1 to application n are pre-installed as the applications AP respectively used by airline 1 to airline n. FIG. 8 shows an example in which one of the multiple applications AP has started and can run.

The application AP has a function for generating data ("write data" below) including the information to be written to the RFID tag 7A of the ticket to be issued, and data ("print data" below) including information related to the image to be printed on the ticket, when producing a ticket.

Note that the application AP does not output data instructing cutting the medium B when producing a ticket. As a result, the application AP only needs the ability to output print data, and does not need a function for outputting data instructing the timing when the medium B is cut. The application AP can therefore be prevented from becoming complicated.

In FIG. 8, the middleware MW represents software that functions as an interface between the applications AP and the operating system of the host computer 92. More specifically, the middleware MW in this embodiment functions as a device driver for controlling the printer 1. In other words, the middleware MW has functions for generating and sending control data to the printer 1 based on the input process data when process data including the write data and print data described above is input from an application AP. The control data is data conforming to the command language of the printer 1. Print control data and write control data are included in the control data. In this example, the print control data is data conforming to the command language of printer 1, and is data instructing printing an image. The write control data is also data conforming to the command language of printer 1, and is data instructing writing data to the RFID tag 7A.

To produce a ticket, the application AP therefore simply generates write data and print data, and outputs process data including the foregoing data to the middleware MW according to a protocol.

As also shown in FIG. 8, multiple settings files SF (a first settings file SF1 to an n-th settings file SFn) are stored in the storage unit 105 of the printer 1.

A settings file SF is a file storing the values of various print settings. The print settings include, for example, the print speed, print density, margins, start printing position, and stop printing position. More specifically in this embodiment, information specifying the operating mode ("operating mode information" below) is recorded as one setting in the settings files SF. Operating modes are further described below.

The media processing device control unit 100 reads the settings files SF and operates in the specified operating mode. The media processing device control unit 100 also prints an image according to the values of settings contained in the settings files SF.

As shown in FIG. 8, a settings files SF is stored for each application AP. In the example in FIG. 8, the n-th settings file SFn is the settings file SF for the n-th application APn. The airline company pre-installs a settings file SF with the desired values in the storage unit 105 of the printer 1. Storing a settings file SF for an airline is done through a user interface that is provided by a function of the application AP or middleware MW, for example. Further alternatively, a software tool for printer 1 maintenance could be used.

Figure 9:
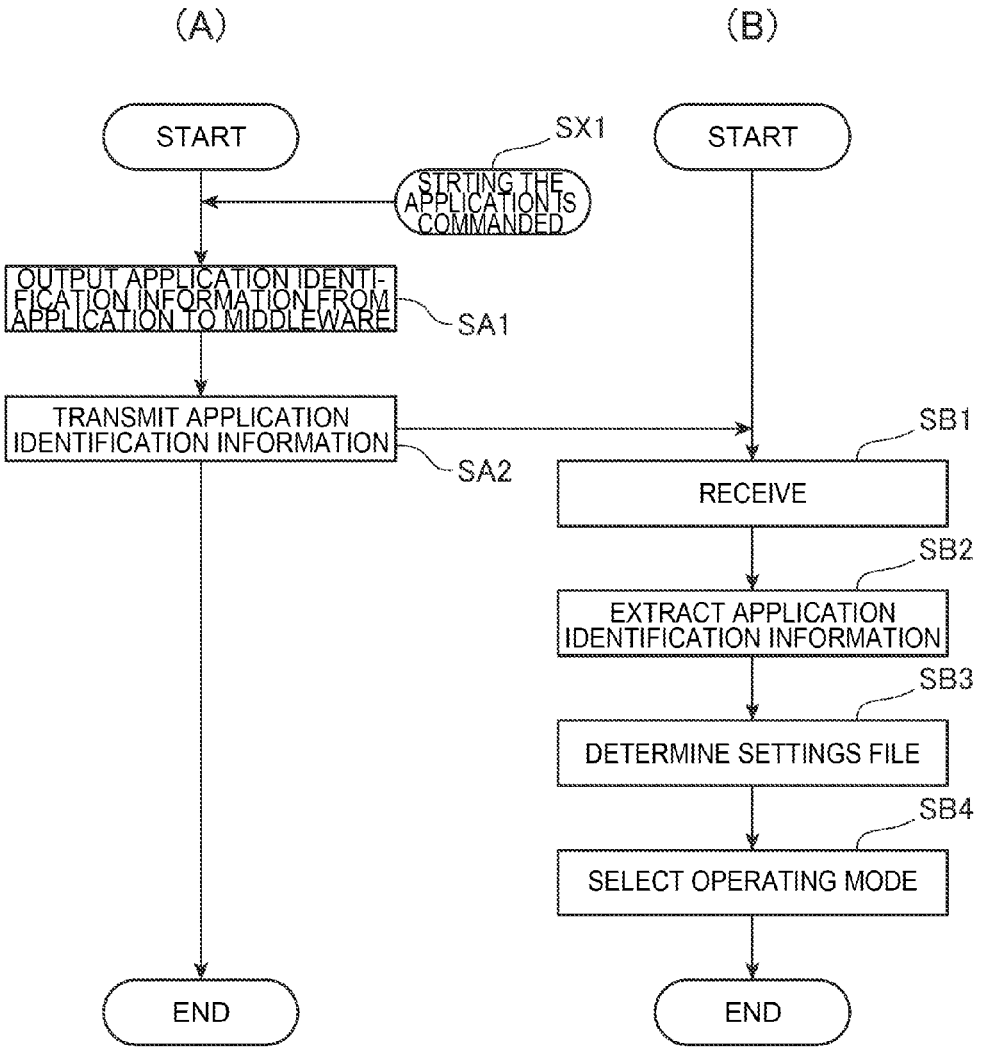
FIG. 9 is a flow chart of the operation of the host computer and printer.

FIG. 9 is a flow chart showing the operation of the printer 1 and the host computer 92 when starting a particular application AP is commanded. Column (A) shows the operation of the host computer, and (B) shows the operation of the printer 1.

In the following description using FIG. 9, the control device control unit 108 functions as an application execution unit that runs an application to generate and output information for processing the medium B. The control device control unit 108 and host communication interface 113 function as a transmission unit that transmits information output by the application.

By storing a settings files SF for each operating mode, the storage unit 105 functions as a print settings storage unit that stores settings values for each operating mode.

In addition to when the host computer 92 starts up, starting the application AP is commanded in events such as described below. As described above, the printer 1 in this embodiment is shared by multiple airline companies, and this sharing is done in situations such as follow. For example, when the printer 1 is used by a particular is known in advance. Each airline therefore uses the printer 1 during a specific period of time, and quits the application AP when this time is over. The airline that uses the printer 1 in the next time period then commands starting the application AP appropriate to that airline, and starts that application AP.

When starting the application AP is commanded (step SX1), the application AP that was started on the host computer 92 outputs application identification information, which is identification information assigned to the application AP, to the middleware MW (step SA1). More specifically, the application AP has a function for outputting application identification information assigned to the application to the middleware MW when the application AP starts. The middleware MW generates transmission data including the application identification information, and outputs to the printer 1 according to a protocol (step SA2).

When the data is received (step SB1), the media processing device control unit 100 of the printer 1 extracts and acquires the application identification information from the received data (step SB2).

Next, the media processing device control unit 100 identifies the settings files SF to be read based on the acquired application identification information (step SB3).

More specifically, the printer 1 relationally stores application identification information and information identifying the settings file SF to be read for the application AP installed in the host computer 92. The relation information is stored in a specific memory area in the storage unit 105, or is defined in the program, as data that can be referenced by the program embodying the functions of the media processing device control unit 100. In step SB3, the media processing device control unit 100 identifies the settings file SF related to the application identification information as the settings file SF to be read.

Note that because operating mode information specifying the operating mode is written in the settings files SF, the printer 1 stores the application identification information relationally to the operating mode information.

As a result of step SB3, the settings file SF that is referenced changes according to the application that was started (according to the application running on the control device), and the media processing device control unit 100 thereafter references the identified settings file SF when printing.

Next, the media processing device control unit 100 determines (selects) the operating mode based on the operating mode information contained in the settings file SF identified in step SB3 (step SB4).

Note that while the operating mode information indicating the operating mode is written in the settings files SF in this embodiment, a configuration in which data containing the relation between the operating mode information and the application identification information is stored separately from the settings files SF, and the operating mode is selected based on this data, is also conceivable.

As a result of the process in step SB4, the operating mode is selected according to the started application (according to the application running on the control device), and the printer 1 thereafter operates in the selected operating mode. The operating modes are described below.

When an application AP starts in this embodiment of the disclosure, the printer 1 selects the operating mode according to the application AP that started. When an application AP starts, the printer 1 also changes the settings file SF to reference to the settings file SF matching the application AP that started. As a result, the printer 1 can execute processes based on the operating mode corresponding to the application AP running on the host computer 92, and the related settings file SF (settings values).

More specifically, the settings file SF to reference and the operating mode to select are automatically selected when an application AP starts. As a result, when the application AP starts, the user does not need to set the operating mode or configure application settings, and user convenience is excellent.

The operating modes are described next.

The operating modes in this embodiment include operating modes MA1, MA2 and operating mode MB. Operating modes MA1, MA2 are each a first operating mode, and operating mode MB is a second operating mode.

In operating mode MB, the media processing device control unit 100 prints an image on the medium B and reads/writes data to the RFID tag 7A, and after stopping conveyance of the medium B, automatically cuts the medium B with the automatic paper cutter 60 instead of entering the standby mode described below.

Operating modes MA1, MA2 are each described below.

Operating Mode MA1

Figure 10:
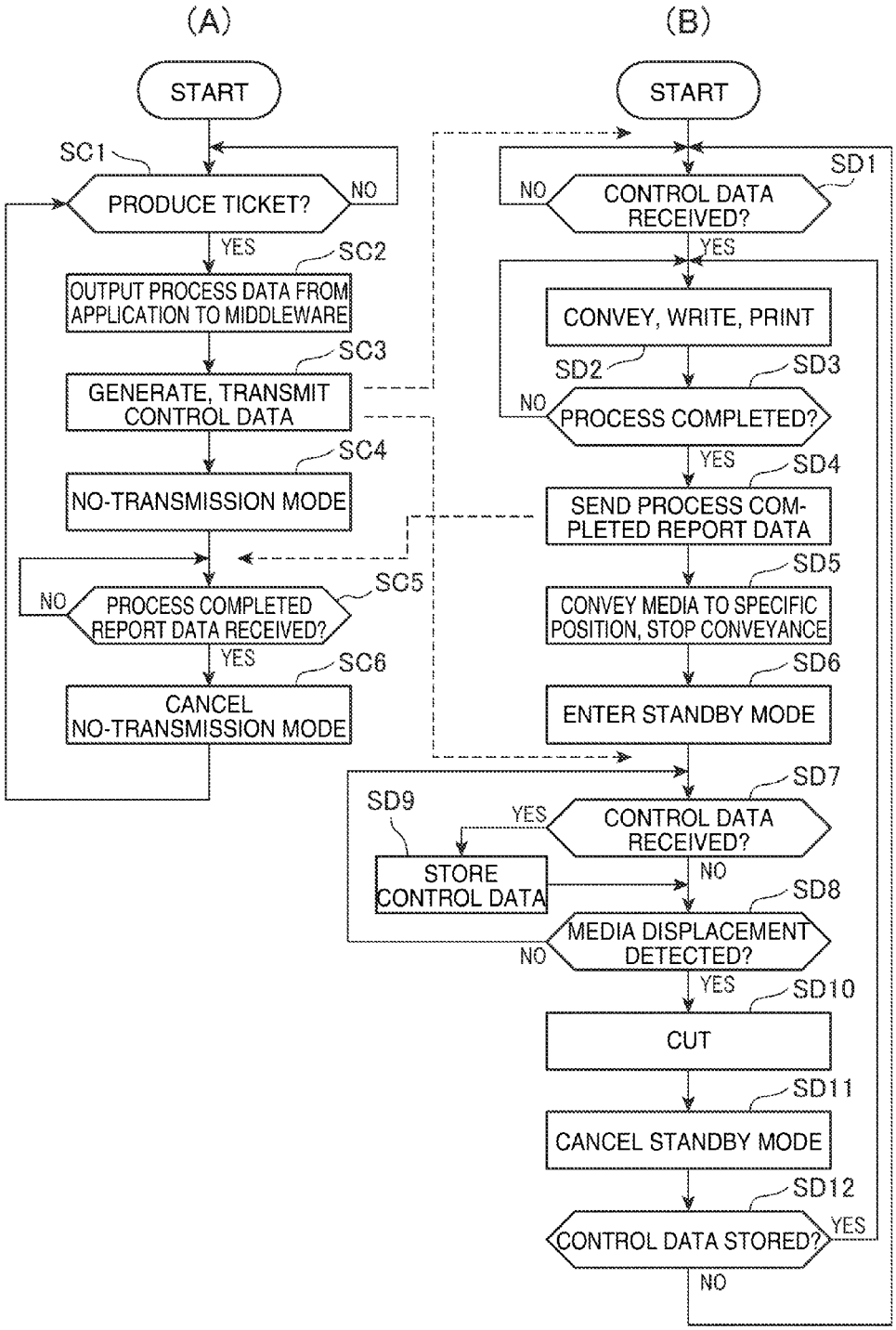
FIG. 10 is a flow chart of the operation of the host computer and printer.

FIG. 10 is a flowchart showing the operation of the host computer 92 and the printer 1 when printing an image on medium B and producing a ticket. Column (A) shows the operation of the host computer 92, and (B) shows the operation of the printer 1.

The operating mode of the printer 1 in the flow chart in FIG. 10 is operating mode MA1.

Starting the application AP, and selecting the settings files SF and operating mode based on the application AP, have already been completed by the process shown in the flow chart in FIG. 9 before the process in the flow chart in FIG. 10 starts. The selected operating mode is operating mode MA1.

As shown in FIG. 10 (A), the application AP determines if a ticket is to be produced (step SC1). The application AP could, for example, determine that a ticket should be issued when required information is input and a command to produce a ticket has been entered through a specific user interface provided by the application AP. Alternatively, the application AP could determine that a ticket should be issued when required information is input and a command to produce a ticket have been input from an external device such as a connected server.

To produce a ticket (step SC1 returns YES), the application AP generates and outputs process data including write data including the information to write to the RFID tag 7A of the issued ticket, and print data including information related to the image to print on the ticket, to the middleware MW (step SC2). Based on the process data, the middleware MW generates and sends control data to the printer 1 (step SC3).

Next, the middleware MW enters a no-transmission state in which control data is not sent to the printer 1 (step SC4). While in this no-transmission state, the middleware MW or the application AP prohibits sending control data to the printer 1. Alternatively, a configuration in which a function of the middleware MW or the application AP displays an appropriate message on the display panel 110 and does not accept a ticket production command when in the no-transmission state is also conceivable.

After entering the no-transmission state, the middleware MW monitors whether or not a process completed report is received (step SC5). The process completed report and the process executed when the report is received are further described below.

The media processing device control unit 100 of the printer 1 monitors if control data is received (step SD1).

If control data was received (step SD1 returns YES), the media processing device control unit 100 controls the conveyance mechanism 63 (such as the paper feed motor 70) to convey the medium B appropriately based on the control data, and at the specified timing writes data to the RFID tag 7A with the tag reader/writer 46 based on the write control data contained in the control data, and prints an image with the print mechanism 64 (such as the thermal head 67) based on the print control data contained in the control data (step SD2). The process performed in this step SD2 is an example of a process applied by the processing unit to the medium B.

While the process of step SD2 executes, the media processing device control unit 100 monitors if processing the medium B was completed (step SD3). More specifically, the media processing device control unit 100 checks if writing data to the RFID tag 7A and printing an image are completed (step SD3).

Completion of writing data to the RFID tag 7A means that writing all data to be written to the RFID tag 7A based on the write control data contained in the control data to the RFID tag 7A has been completed. Completion of printing an image means that printing all images to be printed based on the print control data contained in the control data has been completed. Whether or not both writing data to the RFID tag 7A and printing of images are completed is monitored in step SD3.

When the printing operation is completed, the media processing device control unit 100 sends process completed report data indicating that printing based on the control data is completed to the host computer 92 (step SD4).

Note that in step SD3 and step SD4, the media processing device control unit 100 sends the process completed report data indicating that processing ended as soon as writing data to the RFID tag 7A and image printing are completed. However, the media processing device control unit 100 could be configured to determine that the process was completed and send the process completed report data after the medium B is conveyed to the specific position and conveyance is then stopped by the process of step SD5 described below.

As described above, the middleware MW checks if the process completed report data was received after changing to the no-transmission state (step SC4, step SC5). If the process completed report data was received (step SC5 returns YES), the middleware MW cancels the no-transmission state (step SC6) and transitions to a state enabling sending control data to the printer 1. Next, the process returns to step SC1, and the application AP determines whether or not to produce a ticket.

After sending control data commanding writing data and printing, the host computer 92 in this embodiment thus prohibits sending control data commanding writing data and printing an image related to the next ticket until the process completed report data is received. When the process completed report data is received, the host computer 92 changes to the state enabling sending control data for the next ticket. This configuration has the following effect.

Specifically, control data is not transmitted by the host computer 92 in this configuration until the printer 1 finishes processing the medium B for one ticket. More specifically, outputting control data continuously from the host computer 92 to the printer 1 is prevented. As a result, problems such as the receive buffer of the host computer 92 overflowing and tickets not being produced in response to requests from the host computer 92 can be prevented.

As shown in FIG. 10 (B), after sending the process completed report data, the media processing device control unit 100 controls the conveyance mechanism 63 to convey and stop the medium B so that the position where the medium B is to be cut (the "cutting position" below) is set to the cutting position of the automatic paper cutter 60 (step SD5).

The cutting position of the medium B is a position corresponding to the trailing end of the ticket processed by the processing unit based on the control data. By cutting the medium B at this cutting position, a slip equal to one ticket is cut from the medium B and a ticket is issued.

This step SD5 results in a portion of the medium B being discharged from the paper exit 28.

Next, the media processing device control unit 100 enters the standby mode (step SD6).

In the standby mode, the media processing device control unit 100 keeps conveyance of the medium B stopped. More specifically, the media processing device control unit 100 keeps the paper feed motor 70, which is a stepper motor, in a hold mode during the standby mode, and thereby restricts movement of the medium B in the conveyance direction (movement in the direction moving toward the paper exit 28). More specifically, by keeping the paper feed motor 70 in the hold mode, the media processing device control unit 100 restricts rotation of the platen roller 66 in the medium B conveyance direction. Because the medium B is held pressed between the thermal head 67 and the platen roller 66, movement of the medium B in the medium B conveyance direction is restricted by restricting rotation of the platen roller 66.

Because movement of the medium B is thus controlled, the cutting position of the medium B is prevented from shifting from the cutting position of the automatic paper cutter 60 even if some force is applied to the medium B, such as when the user displaces the medium B in order to cut the medium B or the medium B is pulled. The paper feed motor 70 that functions as a limiting member restricting rotation of the platen roller 66, and the media processing device control unit 100 (drive control unit) that holds the paper feed motor 70, together function as a shifting prevention unit in this embodiment of the disclosure.

In the standby mode, the media processing device control unit 100 also prohibits printing by the print mechanism 64 and writing data to the RFID tag 7A by the tag reader/writer 46. In other words, the media processing device control unit 100 prohibits processing of the medium B by any processing unit when in the standby mode.

When in the standby mode, the media processing device control unit 100 also monitors change in the sensor output of the detector 82 of the media orientation detection means 65 described above, and monitors change in the orientation (displacement in a specific direction) of the medium B waiting on the paper stage 72. In other words, detection of the media orientation is not done in the standby mode, and the medium B is therefore not cut based on detection of a change in orientation even if the orientation of the medium B changes.

After entering the standby mode, the media processing device control unit 100 monitors if a change in the medium. B orientation was detected by the media orientation detection means 65 (step SD8), and determines if control data commanding printing an image on the next ticket, for example, was received (step SD7). Because the process completed report data was already transmitted, control data instructing printing an image on the next ticket could have been sent by the host computer 92 before step SD7.

That a change in the orientation of the medium B was detected by the media orientation detection means 65 means that the user intentionally moved the medium B in order to cut the medium B (issue a ticket).

If control data is received before change in the medium B orientation is detected (step SD7 returns YES), the media processing device control unit 100 stores the received control data in a specific memory area (step SD9), and then goes to step SD8.

If a change in the medium B orientation was detected in the standby mode, the media processing device control unit 100 controls the automatic paper cutter 60 to cut the medium B (step SD10).

As described above, rotation of the platen roller 66 is restricted, and the medium. B is held between the platen roller 66 and thermal head 67, when in the standby mode. The medium B therefore does not move in the conveyance direction, and the cutting position of the medium B does not shift from the cutting position of the automatic paper cutter 60, even if the user moves the medium B before the medium B is cut in step SD10. The cutting position of the medium B and the cutting position of the automatic paper cutter 60 also do not shift during cutting, and the medium B is cut appropriately at the intended position.

More particularly, as shown in FIG. 4, the shifting prevention mechanism including the platen roller 66 is disposed near the automatic paper cutter 60 on the upstream side of the automatic paper cutter 60 in the conveyance direction. More specifically, the place where the medium B is clamped and held stationary, and the place where the medium B is to be cut, are close together. As a result, shifting between the cutting position of the medium B and the cutting position of the automatic paper cutter 60 is minimized even if skewing or slack occur due to change in the orientation of the medium B on the downstream side of where the medium B is held stationary in the conveyance direction.

By cutting in step SD10, a slip equivalent to one ticket is cut from the medium B and the slip can be issued as a ticket.

After cutting the medium B, the media processing device control unit 100 cancels the standby mode (step SD11).

When the standby mode is cancelled, detecting change in the medium B orientation stops, and the medium B is not cut even if the orientation of the medium B changes.

Further accompanying cancelling the standby mode, the media processing device control unit 100 cancels prohibition of printing with the print mechanism 64 and writing data to the RFID tag 7A by the tag reader/writer 46. More specifically, the media processing device control unit 100 allows processing the medium B by a processing unit.

As described above, when the medium B is displaced in a specific direction while in the standby mode in operating mode MA1, or in other words, when the medium B is moved so that it is displaced in a specific direction by the user, the medium B is cut and a ticket is issued. More specifically, a ticket is not issued unless the user intentionally moves the medium B. As a result, tickets can be prevented from accumulating at the paper exit 28 as a result of tickets being continuously produced automatically when not intended by the user. Tickets becoming intermixed with other tickets and being mistakenly mishandled by the user as a result of tickets being produced continuously automatically can also be prevented.

After cancelling the standby mode, the media processing device control unit 100 determines if control data was received during the standby mode and the received control data was stored (step SD12). If control data was stored (step SD12 returns YES), the media processing device control unit 100 returns control to step SD2, and prints an image based on the stored control data. If control data was not stored (step SD12 returns NO), the media processing device control unit 100 returns control to step SD1 and waits to receive control data.

As described above, when control data instructing printing an image for the next ticket, for example, is received while in the standby mode, this embodiment stores the control data and executes the process based on the stored control data after the standby mode is cancelled in conjunction with cutting the medium B. As a result, printing an image on the next ticket can start after the standby mode is cancelled due to cutting the medium B, and process efficiency can be improved.

When in operating mode MA1, the control device control unit 108 controls the warning unit 103 to produce an electronic sound in a specific pattern to report when the standby mode is enabled, a specific time has passed in the standby mode, and when the standby mode is cancelled. As a result, the user can be made aware of information related to the standby mode, and the user can be prompted to move the medium so that the medium is cut if there is a need to cut the medium B while in the standby mode.

Note that configurations that report when any one or any two of specific events occur, including entering the standby mode, a specific time passing while in the standby mode, and cancelling the standby mode, and configurations enabling the user to set the timing when reports are issued are conceivable.

The method of issuing a report is not limited to the warning unit 103 producing an electronic sound, and if the configuration has a display unit, an appropriate message could be displayed on the display unit.

Note that reports related to the standby mode as described above are also issued in operating mode MA2 described below.

The control data received in step SD1 in the foregoing description of operating mode MA1 is also referred to as first control data, and the control data thereafter received from the host computer 92 is also referred to as second control data. In other words, the second control data is the control data the host computer 92 sends to the printer 1 through the transmission unit after sending the first control data and receiving the process completed report data.

A configuration that prohibits receiving control data when the standby mode is entered in step SD6 in the flow chart in FIG. 10, and allows receiving control data after the standby mode is cancelled, is also conceivable.

Prohibiting receiving control data is done, for example, by the media processing device control unit 100 sending specific data to the control device control unit 108 of the host computer 92, and requesting stopping transmission of control data. Permitting receiving control data is done, for example, by the media processing device control unit 100 sending specific data to the control device control unit 108 of the host computer 92 and requesting cancelling stopping control data transmission.

With this configuration, the media processing device control unit 100 receives control data for the next ticket and can start processing the medium B after cancelling the standby mode and entering a mode enabling processing the medium B to produce the next ticket.

Operating Mode MA2

Operating mode MA2 is described next.

Figure 11:
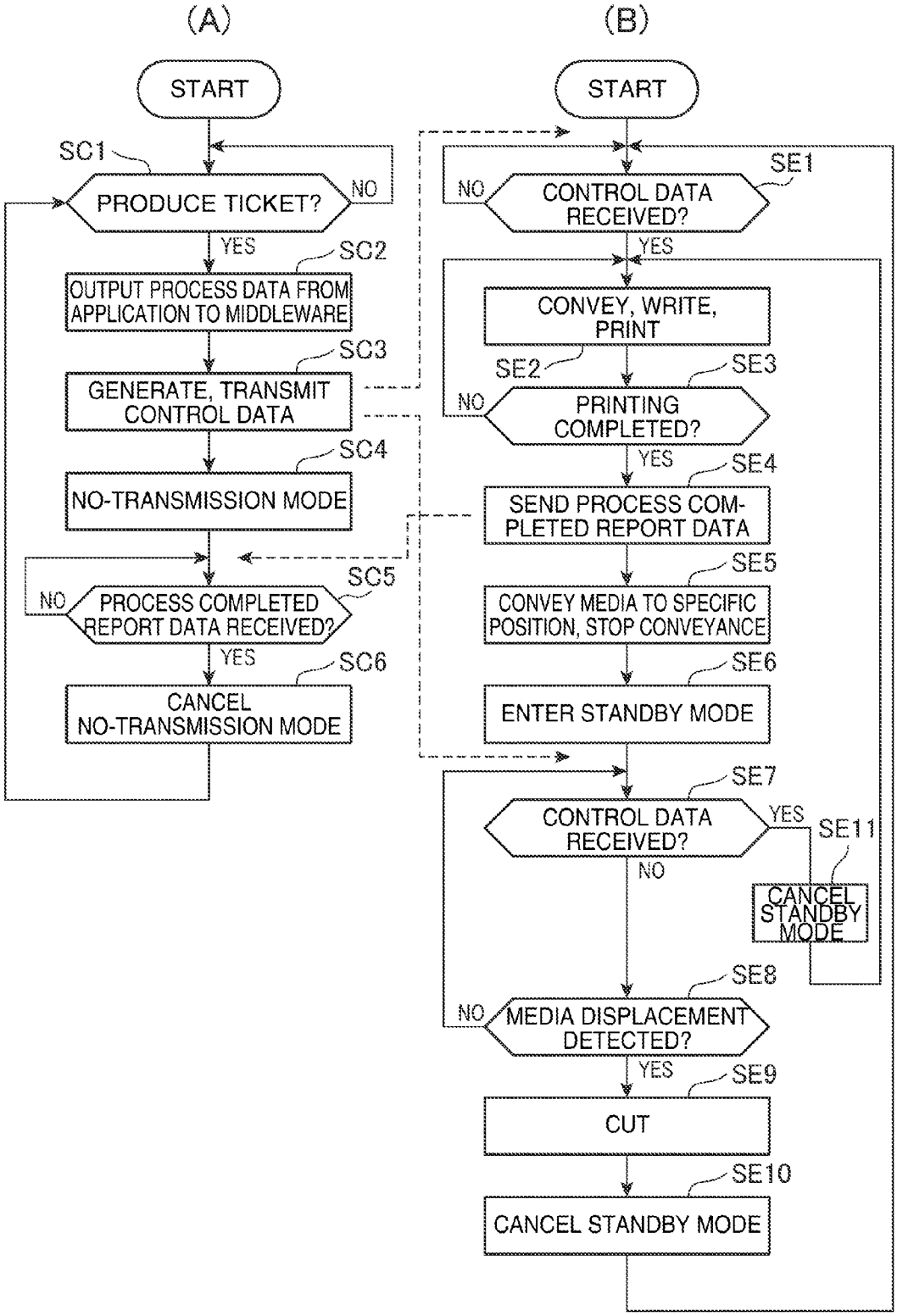
FIG. 11 is a flow chart of the operation of the host computer and printer.

FIG. 11 is a flow chart showing the operation of the host computer 92 and the printer 1 when printing an image on the medium B and producing a ticket. Column (A) shows the operation of the host computer 92, and (B) shows the operation of the printer 1. Note that the operating mode of the printer 1 in the flow chart in FIG. 11 is operating mode MA2.

In FIG. 11, the operation of the host computer 92 is the same as in the flow chart shown in FIG. 10 (A), like steps are identified by like reference numerals, and further description thereof is omitted.

In the operation of the printer 1 shown in column (B) in FIG. 11, steps SE1 to SE6 are identical to steps SD1 to SD6 in FIG. 10 column (B), and further description thereof is omitted.

As shown in FIG. 11 (B), the printer 1 enters the standby mode in step SE6. After entering the standby mode, the media processing device control unit 100 monitors if a change in the medium B orientation was detected by the media orientation detection means 65 (step SE8), and determines if control data commanding printing an image on the next ticket, for example, was received (step SE7).

If a change in the orientation of the medium B was detected before control data is received (step SE8 returns YES), the media processing device control unit 100 controls the automatic paper cutter 60 to cut the medium B (step SE9), and cancels the standby mode (step SE10). The media processing device control unit 100 then returns control to step SE1, and waits to receive control data.

However, if control data is received before a change in the orientation of the medium B is detected (step SE7 returns YES), the media processing device control unit 100 cancels the standby mode (step SE11). When cancelling the standby mode in this event, the media processing device control unit 100 does not cut the medium B. As a result, cutting the medium B and issuing a ticket when not intended by the user, and tickets accumulating near the paper exit 28 as a result, can be prevented.

Note that configurations that cut the medium B when the standby mode is cancelled in step SE11, and configurations that enable the user to set whether or not to cut the medium B, are also conceivable.

Next, the media processing device control unit 100 returns control to step SD2, and writes data to the RFID tag 7A and prints an image based on received control data.

This operating mode MA2 thus differs from operating mode MA1 by cancelling the standby mode and printing an image based on received control data when control data is received in the standby mode. The effect of this process is described below.

When control data is received while in the standby mode, the printer 1 prints an image based on the control data. As a result, unnecessarily stopping ticket production when there is a request to produce a ticket, and a resulting drop in process efficiency, can be prevented.

In the flow chart in FIG. 11, the media processing device control unit 100 cancels the standby mode and prints based on the control data when control data is received during the standby mode, for example, but could alternatively be configured as follows.

When control data commanding printing an image on the next ticket, for example, is received in the standby mode in this configuration, the media processing device control unit 100 maintains the standby mode for a specific time after control data is received. If displacement of the medium B is not detected during this specific time, the standby mode is cancelled after the specific time passes, and processing based on the received control data proceeds.

The media processing device control unit 100 does not cut the medium B when cancelling the standby mode. As a result, cutting the medium B and issuing a ticket when not intended by the user, and tickets accumulating near the paper exit 28 as a result, can be prevented. Configurations that cut the medium B, and configurations that enable the user to set whether or not to cut, are both conceivable.

Thus comprised, when control data commanding printing an image on the next ticket, for example, is received in the standby mode, the printer 1 maintains the standby mode for a specific time instead of immediately printing an image based on the control data. As a result, time for the user to move the medium B so that it is displaced in a specific direction and intentionally cut the medium B can be assured. In addition, because printing an image, for example, based on the control data is done after waiting a specific time, unnecessarily stopping ticket production when there is a request to produce a ticket, and a resulting drop in process efficiency, can be prevented.

Other configurations are also conceivable as described below.

When displacement of the medium B is not detected for a specific time after the standby mode is entered, the media processing device control unit 100 in another exemplary configuration stays in the standby mode whether or not control data specifying printing an image on the next ticket is received, for example.

The printer 1 in this configuration maintains the standby mode for a specific time after entering the standby mode regardless of whether control data is received. As a result, time for the user to move the medium B so that it is displaced in a specific direction and the medium B is intentionally cut can be assured even if control data is received soon after the standby mode is entered.

The control data received in step SE1 in the foregoing description of operating mode MA2 is also referred to as first control data, and the control data thereafter received from the host computer 92 is also referred to as second control data. In other words, the second control data is the control data the host computer 92 sends to the printer 1 through the transmission unit after receiving the process completed report data.

Operation of the printer 1 when the power turns on/off is described next.

As described above, time is spent in a standby mode when the operating mode is operating mode MA1 or operating mode MA2. The power can conceivably be turned off during this specific time, or more specifically while the medium B for one ticket is discharged from the paper exit 28. In this event, the printer 1 executes the following process when the operating mode is set to operating mode MA1 or operating mode MA2.

Figure 12:
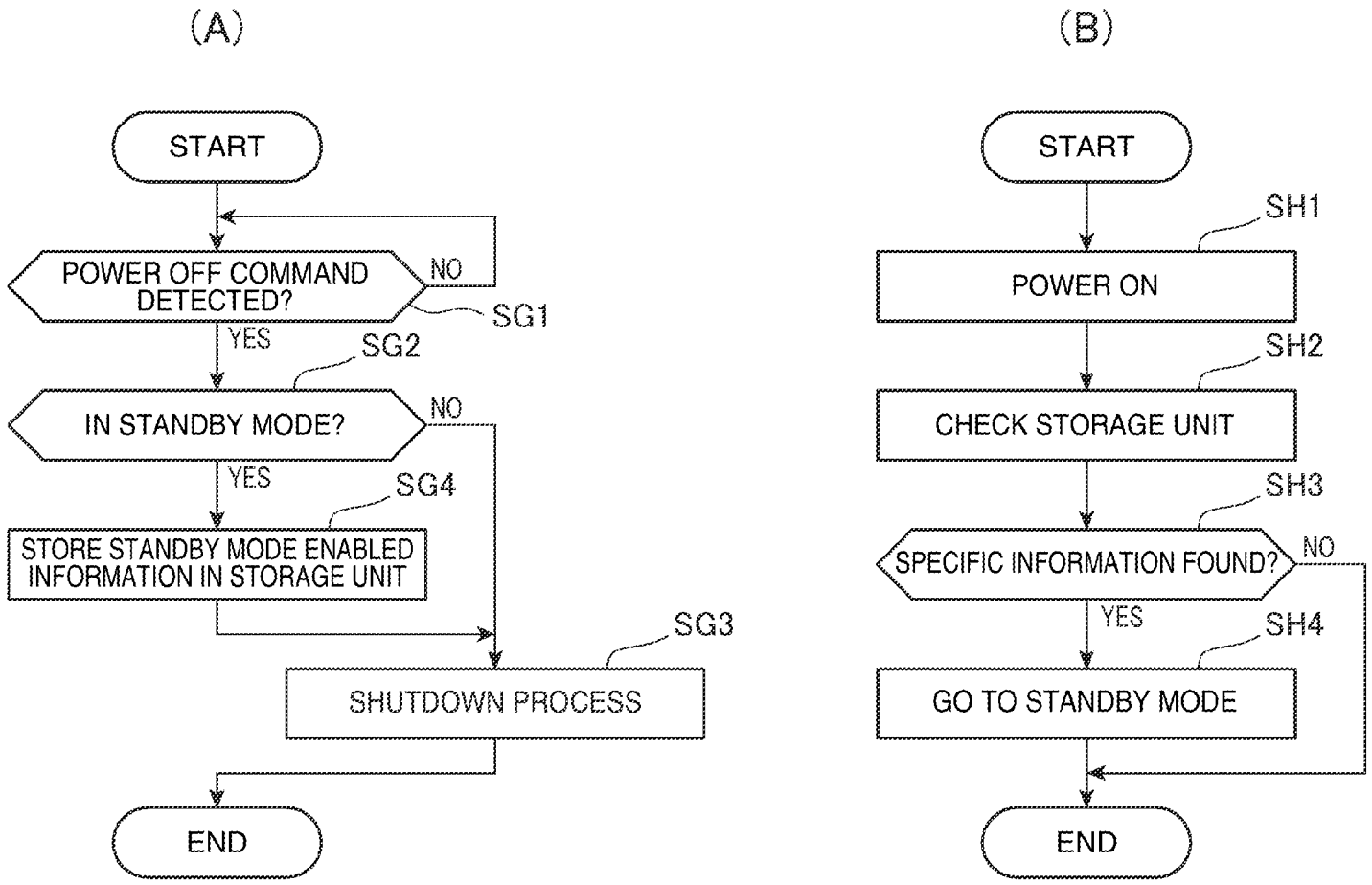
FIG. 12 is a flow chart of printer operation.

FIG. 12 (A) is a flow chart showing the operation of the printer 1 when the power is on.

As shown in FIG. 12 (A), the media processing device control unit 100 monitors if a power off command is asserted (step SG1). If a power off command is detected (step SG1 returns YES), the media processing device control unit 100 determines if the standby mode is active (step SG2). If not in the standby mode (step SG2 returns NO), the media processing device control unit 100 executes the shutdown process (step SG3). A shutdown process is a process that saves specific data to nonvolatile memory, terminates the connection to the host computer 92, and turns the power off normally.

If the standby mode is active when the power off command is received (step SG1 returns YES), the media processing device control unit 100 stores information indicating the standby mode is active at a specific address in the storage unit 105, which is nonvolatile memory. Next, the media processing device control unit 100 goes to step SG3 and executes the shutdown process.

FIG. 12 (B) is a flow chart of printer 1 operation when turning the power on is commanded after the power has been turned off.

As shown in FIG. 12 (B), after the power turns off (step SH1), the media processing device control unit 100 reads a specific storage area in storage unit 105 (step SH2) and determines if information indicating the standby mode has been stored (step SH3). If this specific information is stored, the printer 1 was in the standby mode the last time the power was turned off. In this event, the medium B for one ticket is discharged from the paper exit 28, and the standby mode must be reset so that the user can command cutting the medium B. However, if this specific information is not stored, the printer 1 was not in the standby mode when the power was last turned off. In other words, by determining if the specific information is stored in step SH3, the media processing device control unit 100 can determine if the standby mode was active the last time the power was turned off.

If the information is stored (step SH3 returns YES), the media processing device control unit 100 deletes the information from storage unit 105, and enters the standby mode (step SH4). As a result, the user is enabled to intentionally cut the medium B. However, when the information is not stored (step SH3 returns NO), the media processing device control unit 100 does not enter the standby mode.

This configuration enables entering the standby mode the next the power turns on when the power is turned off in the standby mode without cutting the medium B. As a result, after the next time the power turns on, the user can command cutting the medium B and the medium B can be cut when a change in the orientation of the medium B is detected.

The feed button FB is described next.

As described above, there is also a standby period when the operating mode is set to operating mode MA1 or operating mode MA2. An error can also occur in the media orientation detection means 65 or related parts when in the standby mode, and detecting a change in the orientation of the medium B may not be possible.

As a result, when the feed button FB is operated during the standby mode, the media processing device control unit 100 controls the automatic paper cutter 60 to cut the medium B and cancel the standby mode. The user can therefore control intentionally cutting the medium B even when an error occurs in the media orientation detection means 65.

Note that configurations that cut when the feed button FB is operated in a specific manner, such as the feed button FB being pressed a specific number of times within a specific time, in order to detect if the user has intentionally instructed cutting are also conceivable. Configurations that cut if the feed button FB is operated when a specific error has occurred are also conceivable. Configurations that detect operation of a switch other than a feed button FB are also conceivable.

As described above, a printer 1 according to this embodiment has a media orientation detection means 65 (detection unit) that detects displacement of the medium B discharged from the paper exit 28 to a direction other than the conveyance direction of the conveyance mechanism 63. The media processing device control unit 100 (control unit) of the printer 1 controls cutting the medium B with the automatic paper cutter 60 when the media orientation detection means 65 detects displacement of the medium B, and after controlling the automatic paper cutter 60 allows processing the medium B by a processing unit (tag reader/writer 46).

When the medium B is moved and displaced in the specific direction in this configuration, the medium B is cut and a ticket is issued. As a result, accumulation of tickets near the paper exit can be prevented.

A printer 1 according to this embodiment has a communication unit that receives control data requesting processing the medium B by a processing unit, and after controlling the automatic paper cutter 60, the media processing device control unit 100 allows the communication unit to receive control data.

More specifically, as described in operating mode MA1 above, when the standby mode is entered in step SD6 in the flow chart in FIG. 10 while in operating mode MA1, a configuration that prohibits receiving control data, cancel the standby mode, and then allow receiving control data is also conceivable.

In this configuration, the media processing device control unit 100 cancels the standby mode, enables processing the medium B for the next ticket, and then enables receiving control data for the next ticket and starting processing the medium B.

The media processing device control unit 100 in this embodiment detects displacement of the medium B by the media orientation detection means 65 for a predetermined time after stopping conveyance of the medium B.

Time for the user to displace the medium B and cut the medium B after medium B conveyance stops can therefore be assured by this configuration.

The printer 1 in this embodiment also has a warning unit 103, and the media processing device control unit 100 controls the warning unit 103 to report when waiting to cut with the automatic paper cutter 60.

This configuration enables making the user aware that the automatic paper cutter 60 is waiting to cut.

The media processing device control unit 100 of the printer 1 in this embodiment controls cutting the medium B by the automatic paper cutter 60 when the media orientation detection means 65 detects displacement of the medium B, and controls processing the medium B by a processing unit if the communication unit receives control data while in the standby mode waiting for the media orientation detection means 65 to detect displacement of the medium B.

When control data is received when in the standby mode, the printer 1 in this configuration prints an image based on the control data. As a result, unnecessarily stopping ticket production when there is a request to produce a ticket, and a resulting drop in process efficiency, can be prevented.

When control data is received in the standby mode in operating mode MA2 in this embodiment, the media processing device control unit 100 could be configured to control a processing unit to process the medium. B based on the control data after holding the standby mode for a predetermined time after the control data is received.

When control data is received in the standby mode in this configuration, the printer 1 holds the standby mode for a specific time instead of immediately processing the medium B based on the control data. As a result, time for the user to move the medium B in the specific displacement direction and intentionally cut the medium B can be assured.

The media processing device control unit 100 in this embodiment also controls processing the medium. B by the processing unit without cutting the medium. B with the automatic paper cutter 60 when control data is received in the standby mode.

This configuration can prevent the medium B being cut, tickets being issued, and tickets accumulating at the paper exit.

The media processing system 91 according to this embodiment includes a host computer 92 (control device) and a printer 1 (media processing device). The host computer 92 has a transmission unit that sends control data instructing processing the medium B. The printer 1 has a media orientation detection means 65 that detects displacement of the medium B in a direction different from the conveyance direction after conveyance by the conveyance mechanism 63 stops, and a media processing device control unit 100 that controls the automatic paper cutter 60 to cut the medium B when the media orientation detection means 65 detects this displacement of the medium B. The media processing device control unit 100 of the printer 1 sends process completed report data through the communication unit to the host computer 92 when the medium B has been processed by the processing unit.

When the medium B is moved so that it is displaced in a specific direction, the medium B is cut and a ticket is issued. As a result, tickets being automatically produced continuously and then accumulating at the paper exit as a result can be prevented.

The printer 1 in this configuration sends a process completed report to the host computer 92 when a process was executed by the processing unit. The host computer 92 can therefore know that the process was completed by the printer 1, and based thereon can execute a corresponding process.

After receiving the process completed report data, the host computer 92 in this embodiment sends second control data through the transmission unit to the media processing device.

In this configuration, the host computer 92 sends the second control data after receiving the process completed report. When the host computer 92 has not finished processing the medium B for one ticket, the host computer 92 is therefore prevented from sending control data instructing processing the medium B for the next ticket to the printer 1. As a result, problems such as control data being output continuously from the host computer 92 to the printer 1, the printer 1 buffer overflowing as a result, and tickets not being produced in response to host computer 92 requests can be prevented.

The host computer 92 in this embodiment also has a control device control unit 108 (application execution unit) that runs an application AP that generates and outputs information for processing a medium B, and a transmission unit that transmits the information output by the application AP. The printer 1 has a communication unit that receives information sent by the transmission unit, a print mechanism 64 that operates in a first operating mode or a second operating mode that differs from the first operating mode based on the received information, and a media processing device control unit 100 that selects the first operating mode or the second operating mode based on the application AP that generates the information.

Because the printer 1 selects the first operating mode or the second operating mode based on the application AP running on the host computer 92 in this configuration, the printer 1 can operate in an operating mode appropriate to the application AP. More specifically, the printer 1 can execute processes that are responsive to multiple applications AP installed on the host computer 92.

Also in this embodiment, the control device control unit 108 (application execution unit) of the host computer 92 starts the application AP, and the media processing device control unit 100 of the printer 1 selects the first mode or second mode based on the application AP started by the application execution unit.

This configuration thus enables selecting a first operating mode or a second operating mode according to the application AP started on the host computer 92.

When an application AP starts, the transmission unit of the host computer 92 in this embodiment sends identification information for the application AP to the communication unit of the printer 1. The printer 1 has a storage unit 105 that stores relationship information relating the identification information to an operating mode, and the media processing device control unit 100 selects the first operating mode or the second operating mode based on the stored relationship information and transmitted identification information.

Using the application AP identification information, this configuration can select the operating mode of the media processing device based on an application starting on the control device.

The printer 1 in this embodiment also has a storage unit 105 (print settings storage unit) that stores first operating mode settings and second operating mode settings for the print mechanism 64 (print unit). When information is received by the communication unit, the media processing device control unit 100 selects the first operating mode settings or the second operating mode settings stored in the storage unit based on the application AP that generated the information.

Because the operating mode and settings are selected based on the application AP of the host computer 92 in this configuration, the printer 1 can operate using the settings appropriate to the application AP.

In this embodiment, the media processing device control unit 100 (control unit) of the printer 1 executes the following process in operating mode MA1. Specifically, the media processing device control unit 100 controls the print mechanism 64 to print an image for one ticket on the medium B, conveys the medium B with the conveyance mechanism 63 until part of the medium B is discharged from the paper exit 28, and then enters a standby mode. Until the media orientation detection means 65 (detection means) detects displacement of the medium B while in the standby mode, the media processing device control unit 100 stops the print mechanism 64 from printing an image on the next ticket. When the media orientation detection means 65 detects displacement of the medium B, the media processing device control unit 100 cuts the medium B with the automatic paper cutter 60 and cancels the standby mode.

When the medium B is moved and displaced in a specific direction by the user while in the standby mode in this configuration, the medium B is cut and a ticket is issued. This prevents tickets from accumulating near the paper exit 28.

When the media processing device control unit 100 in this embodiment receives control data instructing printing an image on the next ticket, for example, while in the standby mode, the media processing device control unit 100 stores the control data, and after cancelling the standby mode as a result of cutting the medium B, executes a process based on the stored control data.

After cancelling the standby mode in conjunction with cutting the medium B, this configuration starts printing the image of the next ticket, and can improve process efficiency.

In operating mode MA2 in this embodiment, the media processing device control unit 100 controls the print mechanism 64 to print an image for one ticket on the medium B, conveys the medium B by the conveyance mechanism 63 until part of the medium B is discharged from the paper exit 28, then stops conveyance and enters the standby mode. When the media orientation detection means 65 detects displacement of the medium B while in the standby mode, the media processing device control unit 100 cuts the medium B with the automatic paper cutter 60 and cancels the standby mode. If control data instructing printing an image for the next ticket is received from the host computer 92 while in the standby mode, the media processing device control unit 100 cancels the standby mode and executes a process based on the received control data.

When control data is received while in the standby mode, the printer 1 in this configuration prints an image based on the control data. As a result, stopping production of tickets unnecessarily even though a ticket production request is received, and a resulting drop in process efficiency, can be prevented.

A printer 1 operating in operating mode MA2 in this embodiment could be configured as described below.

When control data instructing printing an image for the next ticket, for example, is received in the standby mode, the media processing device control unit 100 holds the standby mode for a specific time after the data is received. If displacement of the medium B is not detected during this specific time, the media processing device control unit 100 cancels the standby mode after the specific time passes, and then prints based on the received control data.

When control data instructing printing an image for the next ticket, for example, is received in the standby mode in this configuration, the printer 1 continues the standby mode for a specific time instead of immediately printing an image, for example, based on the control data. As a result, time for the user to move and displace the medium B in a specific direction and intentionally cut the medium B can be assured. Furthermore, because an image based on the control data is printed, for example, after the specific time passes, stopping production of tickets unnecessarily even though a ticket production request is received, and a resulting drop in process efficiency, can be prevented.

A printer 1 operating in operating mode MA2 in this embodiment could also be configured as described below.

More specifically, when displacement of the medium B is not detected for a specific time in the standby mode, the media processing device control unit 100 holds the standby mode whether or not control data instructing printing an image for the next ticket is received.

In this configuration, the printer 1 continues in the standby mode whether or not control data is received while in the standby mode. As a result, time for the user to move and displace the medium B in a specific direction and intentionally cut the medium B can be assured even if control data is received soon after entering the standby mode. In addition, stopping production of tickets unnecessarily even though a ticket production request is received, and a resulting drop in process efficiency, can be prevented.

In operating modes MA1, MA2 in this embodiment, the media processing device control unit 100 reports when a specific time passes in the standby mode, or when the standby mode is cancelled. In addition to producing a sound with the warning unit 103, the report could be issued by displaying a message on a display unit when a display unit is available.

This configuration can inform the user that the standby mode is active, that a specific time passed in the standby mode, or that the standby mode was cancelled, and can prompt the user to move and cut the medium B when cutting the medium B is necessary while in the standby mode.

When a power off command is asserted in the standby mode in operating modes MA1, MA2, the media processing device control unit 100 in this embodiment stores information indicating that the standby mode is enabled in the storage unit 105. When a command to turn the power on is then asserted, the media processing device control unit 100 references the storage unit 105 and determines if the standby mode was active the last time the power turned off. The media processing device control unit 100 then restores the standby mode if the standby mode was active the last time the power turned off.

If the power turned off while in the standby mode without cutting the medium B, this configuration restores the standby mode the next time the power turns on, and the user can cut the medium B after the power turns on again.

When operation of the feed button FB is detected in the standby mode, the media processing device control unit 100 in this embodiment cuts the medium B with the automatic paper cutter 60 and cancels the standby mode.

This configuration enables the user to intentionally cut the medium B when, for example, a problem happens with the media orientation detection means 65 and the medium B is not cut even though it is displaced in the specific direction while in the standby mode.

The media processing device control unit 100 in this embodiment sends process completed report data to the host computer 92 to report completion of the printing or other process after writing data to an RFID tag 7A with the tag reader/writer 46, and printing images with a print mechanism print mechanism 64, based on control data instructing printing an image for one ticket, for example. After sending control data instructing printing an image for one ticket, for example, the control device control unit 108 of the host computer 92 also stops sending control data instructing printing the next ticket image until the process completed report data for the one ticket is received.

When the printer 1 has not finished printing the image for one ticket, this configuration can, for example, prohibit the host computer 92 from sending control data instructing printing an image for the next ticket to the printer 1. As a result, problems such as control data being output continuously from the host computer 92 to the printer 1, the printer 1 buffer overflowing as a result, and tickets not being produced in response to requests can be prevented.

A host computer 92 in the media processing system 91 according to this embodiment has multiple applications AP that generate and output information related to images to print on a medium B. The printer 1 also has plural operating modes, and can change the operating mode according to the application running on the host computer 92.

Because this configuration enables changing the operating mode of the printer 1 according to the application AP running on the host computer 92, the printer 1 can operate in an operating mode appropriate to the application AP. More specifically, the printer 1 can execute processes appropriate to the plural applications on the host computer 92.

The printer 1 in this embodiment changes the operating mode to an operating mode appropriate to the application that was started when an application AP is started on the host computer 92.

More specifically, when an application AP starts, the host computer 92 sends identification information for the application AP that started to the printer 1. The printer 1 stores this application AP identification information relationally to operating mode information identifying the corresponding operating mode, and when identification information is received from the host computer 92, changes the operating mode to the operating mode related to the identification information.

This configuration eliminates the need for the user to select the operating mode when an application starts, reduces the need for the user to perform a complicated task, and causes the printer 1 to operate in an operating mode appropriate to the application.

The printer 1 in this embodiment also stores a settings file SF containing print settings for each application AP. The printer 1 can also change the settings file SF together with the operating mode appropriately to the application AP running on the host computer 92.

This configuration thus enables the printer 1 to operate using the operating mode and settings appropriate to the application AP.

The printer 1 in this embodiment is also configured so that it can change the operating mode to operating modes MA1, MA2 (first operating modes) or operating mode MB (a second operating mode) according to the application AP that started on the host computer 92.

In operating modes MA1, MA2, which are examples of a first operating mode, the medium B is cut and a ticket is issued when the medium B is displaced in a specific direction while in the standby mode. This has the advantage of preventing tickets from being automatically produced continuously and the tickets accumulating near the paper exit as a result.

A benefit of operating mode MB, which is a second operating mode, is that because the medium. B is cut based on printing an image on the medium B, a drop in process efficiency due to the medium B not being cut after an image is printed on the medium B can be prevented.

This configuration thus enables changing the operating mode according to the application to take advantage of the particular merits of the operating modes.

A printer 1 according to this embodiment also has a shift prevention mechanism that prevents movement causing the position where the medium B is to be cut to shift from the cutting position of the automatic paper cutter 60 while in the standby mode.

The shift prevention mechanism in this configuration prevents movement causing the cutting position of the cutter mechanism and the intended cutting position of the medium to shift when in the standby mode, and enables cutting the medium B at the defined position and issuing a ticket.

The shift prevention mechanism in this configuration is preferably disposed near the automatic paper cutter 60 on the upstream side of the automatic paper cutter 60 in the media conveyance direction.

Even if skewing or sagging occur on the downstream side of the shift prevention mechanism when the orientation of the medium B changes, movement between the cutting position of the automatic paper cutter 60 and the position where the medium B is to be cut is minimized, and shifting can be more effectively prevented.

The shift prevention mechanism in this embodiment prevents the medium B from shifting by limiting rotation of the platen roller 66. More specifically, the shift prevention mechanism stops rotation of the platen roller 66 by setting the paper feed motor 70, which is a stepper motor, to a hold state.

This configuration enables the shift prevention mechanism to prevent shifting by using the platen roller 66 of the conveyance mechanism 63 and driving the platen roller 66 with a stepper motor.

The disclosure is described above with reference to a preferred embodiment thereof, but the disclosure is not limited thereto and can be modified and adapted in many ways without departing from the scope of the accompanying claims.

For example, displacement of the medium B in a specific direction is detected by the media orientation detection means 65. However, the means of detecting displacement of the medium B in a specific direction could be any configuration capable of detecting displacement. For example, a configuration having a reflective photosensor disposed to the paper stage 72 so that the sensor output changes when the medium B is displaced in a specific direction is also conceivable.

The configuration of the shift prevention mechanism is also not limited to the foregoing, and any configuration that can prevent shifting between the cutting position of the automatic paper cutter 60 and the intended cutting position on the medium B can be used. For example, a configuration that holds the medium B with a different member than the platen roller 66, and thereby prevents movement of the medium B, is conceivable.

Furthermore, the printer 1 is a thermal printer in this example, but the method of printing is not limited to thermal printing.

The function blocks shown in FIG. 7 can be achieved as desired by the cooperation of hardware and software, and do not suggest a specific hardware configuration. Functions of the printer 1 and host computer 92 could also be handled by separate devices externally connected thereto. The printer 1 and host computer 92 could also operate as described above by executing programs stored on an externally connected storage medium.

Although the present disclosure has been described in connection with the preferred embodiments thereof with reference to the accompanying drawings, it is to be noted that various changes and modifications will be apparent to those skilled in the art. Such changes and modifications are to be understood as included within the scope of the present disclosure as defined by the appended claims, unless they depart therefrom.

What is claimed is:

1. A media processing device comprising:

a processing unit configured to process media;

a cutting unit configured to cut the media processed by the processing unit;

an exit from which the media is discharged;

a conveyance unit configured to convey the media in a media conveyance direction from a cutting position to the exit;

a detection unit configured to detect displacement of the media in a direction different from the media conveyance direction after conveyance of the media by the conveyance unit stops, the detection unit being positioned to not contact and detect displacement of the media in the media conveyance direction;

a limiting unit having a hold mode in which the limiting unit is configured to limit further movement of the media in the media conveyance direction after conveyance of the media by the conveyance unit stops; and a controller configured to receive control data and control the conveyance unit and the limiting unit based on the control data, wherein the controller is configured to control keeping the limiting unit the hold mode after conveyance by the conveyance unit stops, and the controller is configured to control the cutting unit to cut the media while the limiting unit is kept in the hold mode when the detection unit detects displacement of the media during the hold mode and to cancel the hold mode after the media is cut.

2. The media processing device described in claim 1, wherein the conveyance unit has a conveyance roller that rotates and moves the media to the exit; and the limiting unit is a limit member that restricts rotation of the conveyance roller.

3. The media processing device described in claim 1, wherein the conveyance unit has a stepper motor that produces drive power; and the limiting unit is a drive control unit that holds the stepper motor.

4. The media processing device described in claim 1, wherein the media has an IC tag to which data is written; and the processing unit is a reader/writer unit that reads/writes data in the IC tag.

5. A printing device comprising:

a print unit configured to print on media;

a cutting unit configured to cut the media printed by the print unit;

an exit from which the media is discharged;

a conveyance unit configured to convey the media in a media conveyance direction from a cutting position to the exit based on a control data;

a detection unit configured to detect displacement of the media in a direction different from the media conveyance direction after conveyance of the media by the conveyance unit stops, the detection unit being positioned to not contact and detect displacement of the media in the media conveyance direction;

a limiting unit having a hold mode in which the limiting unit is configured to limit further movement of the media in the media conveyance direction after conveyance of the media by the conveyance unit stops; and a controller configured to receive control data and control the conveyance unit and the limiting unit based on the control data, wherein the controller is configured to control keeping the limiting unit in the hold mode after the print unit prints the media, and the controller is configured to control the cutting unit to cut the media while the limiting unit is kept in the hold mode when the detection unit detects displacement of the media during the hold mode and to cancel the hold mode after the media is cut.

6. The printing device described in claim 5, wherein the conveyance unit has a conveyance roller that rotates and moves the media toward the exit; and the limiting unit is a limit member that restricts rotation of the conveyance roller.

7. The printing device described in claim 5, wherein the conveyance unit has a stepper motor that produces drive power; and the limiting unit is a drive control unit that holds the stepper motor.

8. The printing device described in claim 5, wherein the media has an IC tag to which data is written; and the printing device has a reader/writer unit that reads/writes data in the IC tag.

9. A control method of a media processing device including a conveyance unit configured to move media, a limiting unit configured to limit movement of the media, a detection unit configured to detect displacement of the media, and a controller configured to receive control data and control the conveyance unit and the limiting unit based on the control data, the control method comprising:

processing the media based on the control data;

moving the processed media in a media conveyance direction from a cutting position to an exit and discharging the media in the media conveyance direction from the exit by the conveyance unit;

stopping movement of the media after discharging the media from the exit;

keeping the limiting unit in a hold mode after stopping movement of the media to limit further movement of the media in the media conveyance direction;

detecting displacement of the media when the detection unit contacts the media being displaced in a direction different from the media conveyance direction, the detection unit being positioned to not contact and detect displacement of the media in the media conveyance direction;

cutting the media while the limiting unit is kept in the hold mode and when displacement of the media is detected by the detection unit; and canceling the hold mode after cutting the media.

10. The control method of a media processing device described in claim 9, further comprising:

conveying the media by rotation of a conveyance roller; and restricting movement of the media by restricting rotation of the conveyance roller.

11. The control method of a media processing device described in claim 9, the limiting unit being a stepper motor, the control method further comprising:

conveying the media by drive power of the stepper motor; and restricting movement of the media by holding the stepper motor.

12. The control method of a media processing device described in claim 9, wherein the media has an IC tag to which data is written; and processing the media is a process of reading/writing data in the IC tag.

13. The control method of a media processing device described in claim 9, wherein processing the media is a process of printing on the media.

* * * * *